US007961560B2

(12) United States Patent
Hiraga et al.

(10) Patent No.: US 7,961,560 B2
(45) Date of Patent: Jun. 14, 2011

(54) DISPLAY DEVICE FOR TIMEPIECE, MOVEMENT, AND TIMEPIECE

(75) Inventors: Imao Hiraga, Shenzhen (CN); Kenichi Okuhara, Kiso-mura (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

(21) Appl. No.: 11/795,790

(22) PCT Filed: Jan. 24, 2006

(86) PCT No.: PCT/JP2006/301895

§ 371 (c)(1), (2), (4) Date: Jul. 23, 2007

(87) PCT Pub. No.: WO2006/078080

PCT Pub. Date: Jul. 27, 2006

(65) Prior Publication Data

US 2008/0159082 A1 Jul. 3, 2008

(30) Foreign Application Priority Data

Jan. 24, 2005 (JP) ..... 2005-015556
Oct. 21, 2005 (JP) ..... 2005-307201

(51) Int. Cl.
*G04B 19/02* (2006.01)

(52) U.S. Cl. ..... 368/220; 368/28

(58) Field of Classification Search ..... 368/28–40, 368/220–222

See application file for complete search history.

(56) References Cited

U.S. PATENT DOCUMENTS

| | | | | |
|---|---|---|---|---|
| 864,177 | A * | 8/1907 | Mantaras | 368/220 |
| 1,350,131 | A * | 8/1920 | Anderson | 368/220 |
| 3,696,609 | A * | 10/1972 | Dubois | 368/220 |
| 4,247,933 | A * | 1/1981 | Nakamura | 368/269 |
| 4,271,493 | A * | 6/1981 | Tamaru et al. | 368/28 |
| 5,043,955 | A * | 8/1991 | Dubois et al. | 368/228 |
| 5,943,299 | A * | 8/1999 | Genta | 368/28 |
| 6,826,122 | B2 * | 11/2004 | Zaugg | 368/28 |
| 7,496,003 | B2 * | 2/2009 | Muller | 368/228 |
| 2005/0259519 | A1 | 11/2005 | Muller | |

FOREIGN PATENT DOCUMENTS

CH 684455 A3 * 2/1993

(Continued)

*Primary Examiner* — Sean Kayes
(74) *Attorney, Agent, or Firm* — Global IP Counselors, LLP

(57) ABSTRACT

To provide a display device for a timepiece wherein model changes can be easily made with a simple structure in a timepiece with a retro display.

In a day display device, an hour wheel, day intermediate wheel, and cam are disposed on the same axis, and a lever and small day indicator are disposed so as to enclose these components, whereby a simple configuration can be achieved. A large space for accommodating the lever can be provided between the substantial center and the peripheral edge of a main plate on which the hour wheel, day intermediate wheel, and cam rotate on the same axis, and various shapes are made possible by freely extending the lever from the substantial middle to the peripheral edge of the main plate. Therefore, it is possible to form first through third gear parts through, and to provide three positions A through C for incorporating the small day indicator. This has merits in that timepieces of different models can thereby be easily manufactured merely by changing the position for incorporating the small day indicator, and there is no need to change the configuration of the movement when the model is changed.

20 Claims, 14 Drawing Sheets

FOREIGN PATENT DOCUMENTS

| | | | |
|---|---|---|---|
| CH | 690630 | A5 | 11/2000 |
| DE | 19649590 | A1 | 10/1997 |
| JP | H02-281181 | A | 11/1990 |
| JP | H05-69695 | U | 9/1993 |
| JP | 2564930 | Y2 | 11/1997 |
| JP | 2600097 | Y2 | 7/1999 |
| JP | 3140700 | B2 | 12/2000 |
| WO | WO-2004/019140 | A2 | 3/2004 |
| WO | WO 2004/019140 | A2 * | 3/2004 |

* cited by examiner

DISPLAY DEVICE FOR TIMEPIECE, MOVEMENT, AND TIMEPIECE

CROSS-REFERENCE TO THE RELATED APPLICATIONS

This U.S. National stage application claims priority under 35 U.S.C. §119(a) to Japanese Patent Application Nos. 2005-015556 and 2005-307201, respectively filed in Japan on Jan. 24, 2005 and Oct. 21, 2005, the entire contents of which are hereby incorporated herein by reference.

TECHNICAL FIELD

The present invention relates to a display device for a retro timepiece wherein the month, date, day, and other such date and time information is displayed on a fan-shaped display unit, and also relates to a movement and a timepiece.

BACKGROUND ART

In conventional practice, timepieces that have date displays have used ring-shaped date display gears (date wheel, day, wheel) to display the date by sequentially displaying characters of 1-31 for the date and Sun-Sat for the day through the window of a dial. These characters are printed along the periphery of the gears.

Display mechanisms for retro (retrograde) timepieces are known in which the gradations for the date, day, hours, and minute and the like are drawn on a fan-shaped display unit on a dial, and the date and time are indicated by pointers. In these retro-type timepieces, in the case of the day display, the pointer advances sequentially along Sun, Mon, Tue, etc., and after Sat the pointer returns to the Sun position. In order to achieve such two-way pointer movement, the timepiece disclosed in Japanese Patent No. 3140700 (FIGS. 1 and 9) is configured including a day indicator driving wheel to which the rotation of an hour wheel is transmitted, a day indicator turned by the day indicator driving wheel, a cam fixed in place on the day indicator, a lever that rotates in contact with the cam, a small day indicator turned by a lock formed on the lever, and a small day indicator spring for storing force as the small day indicator rotates. Specifically, the rotation of the lever in contact with the cam causes the small day indicator to rotate and the pointer to move back and forth.

SUMMARY OF INVENTION

Problems the Invention is Intended to Solve

However, in a configuration such as the one in Japanese Patent No. 3140700, the shapes of the cam, the lever, and the like are designed so as to operate appropriately in accordance with the layout of the day indicator driving wheel, the day indicator, and the small day indicator, and the configuration relating to the day display is limited to this model. Specifically, the configuration in Japanese Patent No. 3140700 is not a configuration in which changes to other models are planned for, and therefore only a specified model can be provided, and changes in the model require large changes in the design.

Also, in a configuration wherein the cam and lever are located between the day indicator and the small day indicator as in Japanese Patent No. 3140700, the cam and lever tend to have small, detailed shapes, and therefore the structure is likely to be complicated. Consequently, the design and assembly are difficult.

Because of such problems, an object of the present invention is to provide a display device for a timepiece, a movement, and a timepiece wherein model changes are easy to implement due to a simple structure in a display device and a timepiece with a retro display.

Means for Solving the Problems

The display device for a timepiece of the present invention includes a drive wheel rotated by a power source, a driven wheel driven by the drive wheel, a cam rotated via the driven wheel, a rotatable lever that comes in contact with the cam, and a pointer wheel that is coupled with a gear part provided to the lever, and that allows a pointer member to be mounted; wherein the drive wheel, the driven wheel, and the cam are rotated on the same axis.

According to the present invention, a retro display mechanism is assembled with a drive wheel, a driven wheel, a cam, a lever, and other components. Two-way movement is achieved for the pointer member by intermittently driving the gear part by the rotation of the cam. Examples of the configuration whereby the pointer wheel is coupled with the gear part include a configuration wherein the gear part and the pointer wheel are directly meshed, and a configuration wherein another gear or the like is located between the gear part and the pointer wheel.

In the operation of the display device of the present invention, first, the driven wheel is rotated by the drive force of the drive wheel by an amount corresponding to the purpose of the display, such as the date, the month, or the day. Next, the lever in contact with the cam is rotated by the rotation of the cam via the driven wheel. As a result of the rotation of the lever, a pointer member mounted on the pointer wheel coupled with the gear part of the lever moves from an initial end to a last end on the rotating position on the pointer wheel, and the date or time is indicated in sequence by the pointer member. Furthermore, when the pointer member has reached the last end of the rotating position, the pointer wheel rotates in the opposite direction due to the movement of the gear part of the lever that accompanies the completion of the cam cycle, whereby the pointer member returns to the initial end of the rotating position. The date, month, day, or other such calendar information, or the time, is displayed repeatedly as a result of such two-way movement of the pointer member.

Also, in the present invention, since the drive wheel, the driven wheel, and the cam are provided so as to ensure coaxial rotation, a large space to dispose the lever can be used around the drive wheel, the driven wheel, and the cam, and it is therefore possible to provide many models by providing many positions for disposing (incorporating) the pointer wheel.

Since the drive wheel, the driven wheel, and the cam are rotated on the same axis and the drive force of the drive wheel is reliably transmitted to the driven wheel and the cam wheel, the rotation of the lever is reliably controlled by the rotation of the driven wheel and the cam, and the operation of the display device can be stabilized.

Moreover, the present invention is configured from a cam and a lever and other such components with simple structures in addition to the drive wheel, the driven wheel, the pointer wheel, and the other gears, and these components are disposed efficiently according to the space on the main plate of a movement, and the display device can therefore have a simple structure. Therefore, the display device is easily designed and assembled, and product quality can be stabilized.

Also, the position and orientation at which the pointer member is provided can be freely set as soon as the drive wheel, the driven wheel, the cam, the lever, and the like are combined.

It is preferable that the lever be formed into a thin plate shape, and the plate surface thereof BE provided so as to extend in planar fashion facing the main plate.

It is thereby possible to elongate the thin plate-shaped lever into an arbitrary shape around the rotational axis of the drive wheel, the driven wheel, and the cam along a position facing the main plate, such as on the reverse side of a dial provided to the movement, and the location of the lever where the gear part is disposed is not limited. In other words, the degree of freedom in the design can be dramatically improved.

Also, the lever is provided so as to be covered by a gear train or the like disposed on the main plate, which allows for exceptional ease of incorporation. Specifically, it is possible to incorporate the display device of the present invention into the movement without changing the configuration of the gear train or other such components already incorporated into the movement, and a timepiece having a retro display mechanism can therefore be easily provided.

In the display device for a timepiece of the present invention, it is preferable that the side surfaces of the lever and the cam along the thickness direction of the timepiece face each other.

According to the present invention, the timepiece does not become bulky because the side surfaces of the lever and the cam face each other, the lever and the cam overlap in planar fashion, and the lever and cam do take up much space in the thickness direction of the timepiece (the direction from which the timepiece is viewed). Therefore, the movement incorporating the display device can be made thinner.

Also, the strength of the lever can be improved when the lever is disposed so as to enclose the outer periphery of the side surface of the cam.

In the display device for a timepiece of the present invention, it is preferable that the rotational axis of the lever and the gear part be disposed in substantially opposite directions in relation to the rotational center of the drive wheel.

According to the present invention, the rotational axis of the lever and the gear part are disposed sandwiching the drive wheel on either side, which allows for easy accommodation in terms of space, and also for a greater distance from the rotational axis of the lever to the gear part than when the rotational axis of the lever and the gear part are disposed adjacent to each other. The amount by which the lever rotates by receiving the rotation of the cam can thereby be increased, and there is no need to increase the amount of displacement (gap) of the cam to ensure a large amount of rotation for the lever. If the gap of the cam is increased, the urging force on the lever must be increased to an extent that overcomes the frictional resistance of the lever and cam in order to transmit the drive force of the cam to the lever and to return the lever. By contrast, the same amount of lever rotation can be achieved with a smaller cam displacement and a smaller amount of torque, and the motive force needed to operate the display device can be reduced.

Another possibility under consideration is one wherein a spring (urging device) is provided that comes in contact with the lever when the lever is in contact with the cam, and the lever is urged toward the cam by this spring. Yet another possibility is one wherein a spring (urging device) is provided so as to come in contact with the pointer wheel or the like, and the lever is brought into contact with the cam by the urging force of this spring. The return operation of the lever through the rotation of the cam can be achieved by the urging force that acts between the lever and the cam, and chatter of the pointer member can be prevented because the gear part and the pointer wheel that rotate via the lever are reliably meshed.

In the display device for a timepiece of the present invention, it is preferable that the dimension from the rotational axis of the lever to the rotational axis of the pointer wheel be 1.5 to 2.5 times the dimension from the rotational axis of the lever to the rotational axis of the cam.

According to the present invention, the amount of displacement of the lever in the gear train of the gear part is increased to 1.5 to 2.5 times the amount of displacement in the portion where the lever comes in contact with the cam, and the desired amount of lever rotation can be achieved with a smaller amount of cam displacement and a smaller torque.

Also, the length of the gear part of the lever is ensured by the dimensions between the rotational axes of the lever, the cam, and the pointer wheel, and many timepiece models can be easily provided by providing many positions for disposing (incorporating) the pointer wheel along the gear part.

In the display device for a timepiece of the present invention, it is preferable that the gear part be meshed with the pointer wheel regardless of which of the plurality of positions is used to dispose the pointer wheel.

According to the present invention, since the gear part is meshed with the pointer wheel regardless of which of the plurality of positions is used to dispose the pointer wheel, pointer wheels can be rotated to specific angles by a plurality of gear parts even if pointer wheels are disposed at a plurality of positions, and different models can easily be manufactured without changing the position for disposing the pointer wheel. Specifically, if the position of the pointer wheel is changed, the position of the rotational center of the pointer member changes accordingly, and variation in the outer design can therefore be easily achieved.

Also, when the pointer wheel is incorporated, holes or projections that serve as the rotational axis of the pointer wheel are formed on the main plate, bearing, or holding plate according to the number of positions for disposing the pointer wheel. If the positions for disposing the pointer wheel are provided according to the rotational axes on the main plate or bearing, there is no need to change the configuration of the display device when changing the model, and the models are easily changed because a common display device or movement is used in all of the timepiece models. Furthermore, it is possible to greatly reduce the costs required to change the models.

If a large number of positions for disposing the pointer wheel are provided, such as three or more positions, much variation in the models is made possible, and therefore the costs for one model can be reduced, and product development can be promoted.

In a possible example of an aspect in which the gear part is meshed with the pointer wheels when pointer wheels are disposed at a plurality of different positions, a plurality of gear parts meshing with the pointer wheels disposed at the plurality of positions are provided, and the gear parts are formed to a length sufficient to rotate the pointer wheels at specific angles. Also acceptable is an aspect in which a gear train is formed at a plurality of areas in the gear parts, and partial gears in these areas of the gear parts are meshed according to the pointer wheels disposed at each position.

The display device for a timepiece of the present invention preferably includes an urging device for urging the lever to a state of contact with the cam.

According to the present invention, the lever can be reliably brought into contact with the cam without separating, and therefore unsteadiness can be prevented in the lever and pointer member and the like, and the pointer member can be accurately moved.

In the operation of the display device of the timepiece, the urging force of the urging device on the lever accumulates as the lever rotates in a direction away from the rotational center of the cam, and this accumulated urging force is released when the cam cycle is complete, whereby the lever can be instantaneously returned.

In the display device for a timepiece of the present invention, it is preferable that the drive wheel be an hour wheel on which an hour hand is mounted, and an intermediate wheel having a turning pawl for turning the driven wheel is provided between the hour wheel and the driven wheel.

According to the present invention, space for accommodating the lever can easily be ensured from the substantial middle of the main plate towards the peripheral edge of the main plate, because the hour wheel is normally provided in the substantial middle of the main plate. The lever can thereby be provided with various large shapes, and the pointer wheels can be disposed at arbitrary positions.

Also, the driven wheel can be turned instantaneously by one tooth a day by the turning pawl of the intermediate wheel.

In the display device for a timepiece of the present invention, it is preferable that the lever be disposed so as to enclose the periphery of the cam, and that the lever have a projection that comes in contact with the cam.

According to the present invention, the display device can be made thinner because the lever is disposed so as to enclose the periphery of the cam, and the planar position at which the lever rotates and the planar position at which the cam rotates lie substantially on the same plane.

In the display device for a timepiece of the present invention, it is preferable that the plurality of gear parts have mutually different diameters and/or teeth shapes.

When the plurality of gear parts have mutually different diameters, the portions at the borders between the gear parts have a stepped shape.

According to the present invention, when the plurality of gear parts have mutually different diameters, new models can be manufactured because of the changes in the amount by which the pointer wheels are turned in relation to the angle of rotation of the lever, and the changes in the angle of rotation of the pointer members provided to the pointer wheels, depending on the manner in which the pointer wheels are disposed so as to mesh with particular gear parts.

Also, when the plurality of gear parts have mutually different diameters, different designs can be achieved because the distances from the rotational axes of the gear parts to the pointer wheels changes depending on their meshing with particular gear parts, and the positions of the rotational centers of the pointer members in the dial or the like also change accordingly.

When the plurality of gear parts have different teeth shapes, pointer wheels with an appropriate diameter are selected according to the teeth shape of the gear parts, and differences occur in the amounts by which the pointer wheels are turned according to the diameters of the pointer wheels, and therefore different models can be provided due to differences in the angles of rotation of the pointer members, similar to the previous descriptions.

As described above, it is possible to provide many design variations because the angles of rotation of the pointer wheels can be changed in addition to changing the positions of the rotational centers of the pointer members without changing the configuration of the gear parts, which is part of the configuration of the display device.

In the display device for a timepiece of the present invention, it is preferable that the pointer wheels have mutually different diameters and/or teeth shapes according to the positions where the pointer wheels are disposed.

According to the present invention, the angles of rotation of the pointer members can be varied because the differences in the amounts by which the pointer wheels are turned by the gear parts, similar to the manner in which the plurality of gear parts have mutually different diameters and teeth shapes in the configuration previously described. Specifically, different models due to differences in the angles of rotation of the pointer members can be achieved merely by changing the configuration of the pointer wheels, which is part of the configuration of the display device, without changing the configuration of the other components of the display device.

The movement of a timepiece of the present invention allows incorporation of the display device previously described, or a display device other than the display device that includes the drive wheel in the previously described display device and a driven wheel driven by this drive wheel.

According to the present invention, although the movement intended to incorporate the display device is common, it is possible to obtain a retro display based on the display device previously described, as well as other displays; for example, a display wherein a rotating plate is disposed on the reverse side of a dial, and characters on the rotating plate are displayed sequentially through the a window in the dial, or wherein gradations on the dial are indicated by rotating pointers. Various display aspects can thereby be easily provided at low costs, which is extremely beneficial in developing timepiece models.

The timepiece of the present invention includes the display device previously described, and a fan-shaped display unit indicated by the pointer members.

According to the present invention, since the display device exhibits the operation and effects previously described, the same operation and effects can be achieved in the timepiece.

The timepiece of the present invention preferably includes a ring-shaped gear having a display showing the date or time provided along the periphery, wherein the rotational axis of the lever and the rotational axis of the pointer wheel are disposed on the internal peripheral side of the ring-shaped gear.

A so-called date indicator (calendar indicator) or a day indicator can be given as an example of the ring-shaped gear.

According to the present invention, the displays of Sun through Sat or 1 through 31 on the ring-shaped gear are formed by printing or other such methods, and the positions of the display or the design can be easily changed by changing the printing. The number of design patterns can thereby be increased by the number of different combinations of the display design on the ring-shaped gear, the rotational range of the pointers in the retro display device, and the design relating to the fan-shape of the display unit.

Also, since the rotational axis of the lever and the rotational axis of the pointer wheel are housed on the internal peripheral side of the ring-shaped gear, the display device for a timepiece of the present invention can be disposed so as to be substantially housed within the internal periphery of the ring-shaped gear, which is favorable in terms of space. As previously described, the display device for a timepiece of the present invention has a simple structure, and therefore it is possible to have much variation in the timepiece models without complicating the structure of the movement, even if the display device is disposed within the internal periphery of the ring-shaped gear.

BEST MODE FOR CARRYING OUT THE INVENTION

First Embodiment

Figure 1:
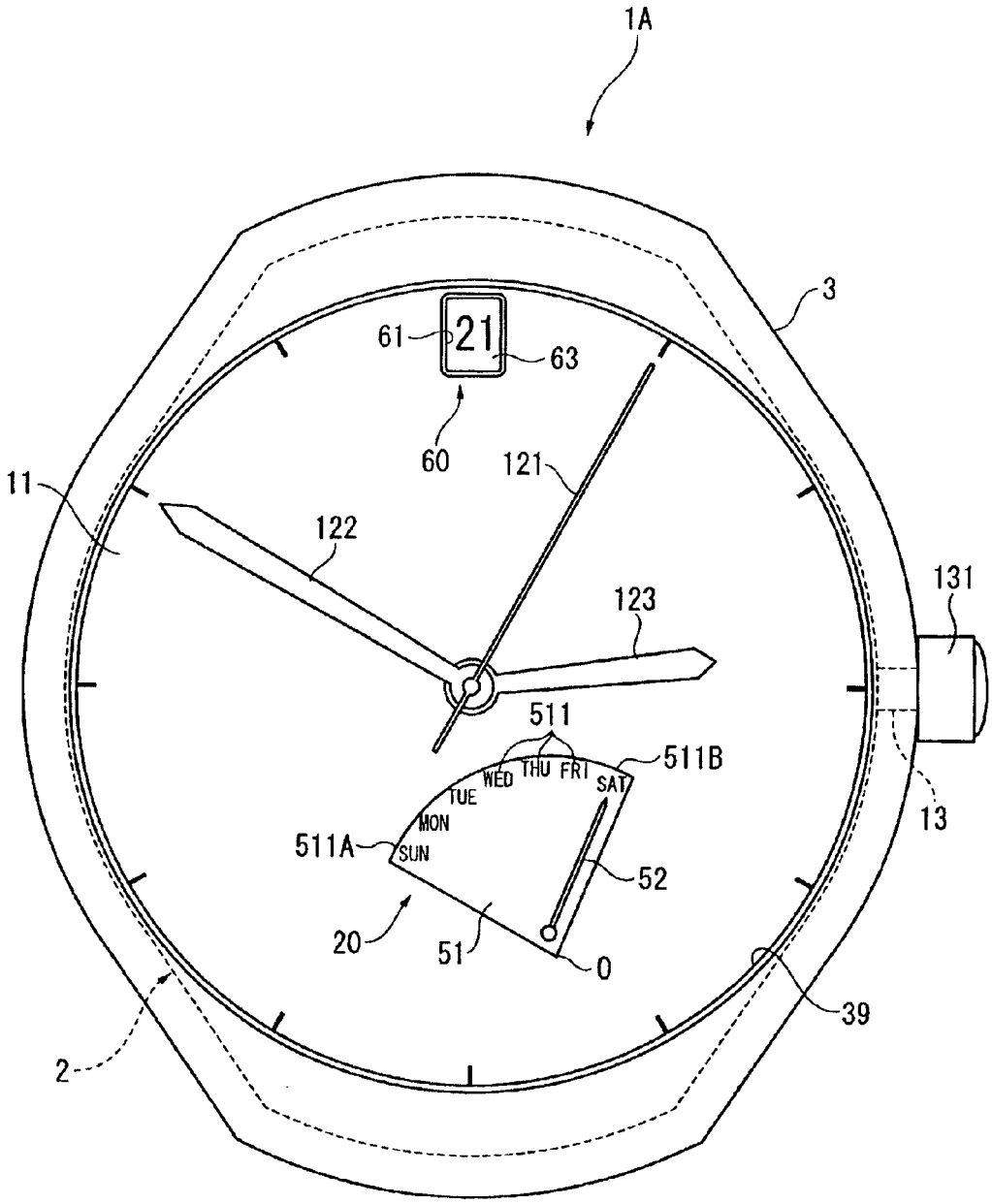
FIG. 1 is a plan view showing the external appearance of a timepiece in the first embodiment of the present invention.

The first embodiment of the present invention is described below with reference to the diagrams.

In the descriptions of the second and subsequent embodiments, configurations similar to the first embodiment described below are denoted with the same reference numerals, and the descriptions are either omitted or simplified.

FIG. 1 is a front side external view of a timepiece 1A of the present embodiment.

The timepiece 1A is a wristwatch (a watch) having a movement 2 as a drive device, housed in a case 3. The timepiece may be a quartz timepiece, a mechanical timepiece, or an electronically controlled mechanical timepiece, but the timepiece 1A of the present embodiment is configured as an analog quartz timepiece. Mounted on the movement 2 are a dial 11 provided facing a circular opening 39 in the case 3, and a crown 131 for operating a winding stem 13. The dial 11 is formed by metal plate perforation or electroforming, injection molding of a synthetic resin, or the like, and the time (hours, minutes, seconds), date, and day are all displayed on the dial 11. Specifically, a seconds hand 121, a minute hand 122, and an hour hand 123 are provided as the configuration of the time display in the substantial middle of the dial 11. A rectangular window 61 is also provided in the 12:00 direction of the dial 11, and the dates printed on a date indicator 63 are displayed in sequence by the rotation of the date indicator 63, which is provided to the reverse side of the dial 11. Furthermore, a fan-shaped display unit 51 is provided in substantially the 5:30 direction of the dial 11, and the display of this display unit 51 has a retro style in which a day hand 52 moves back and forth.

Figure 2:
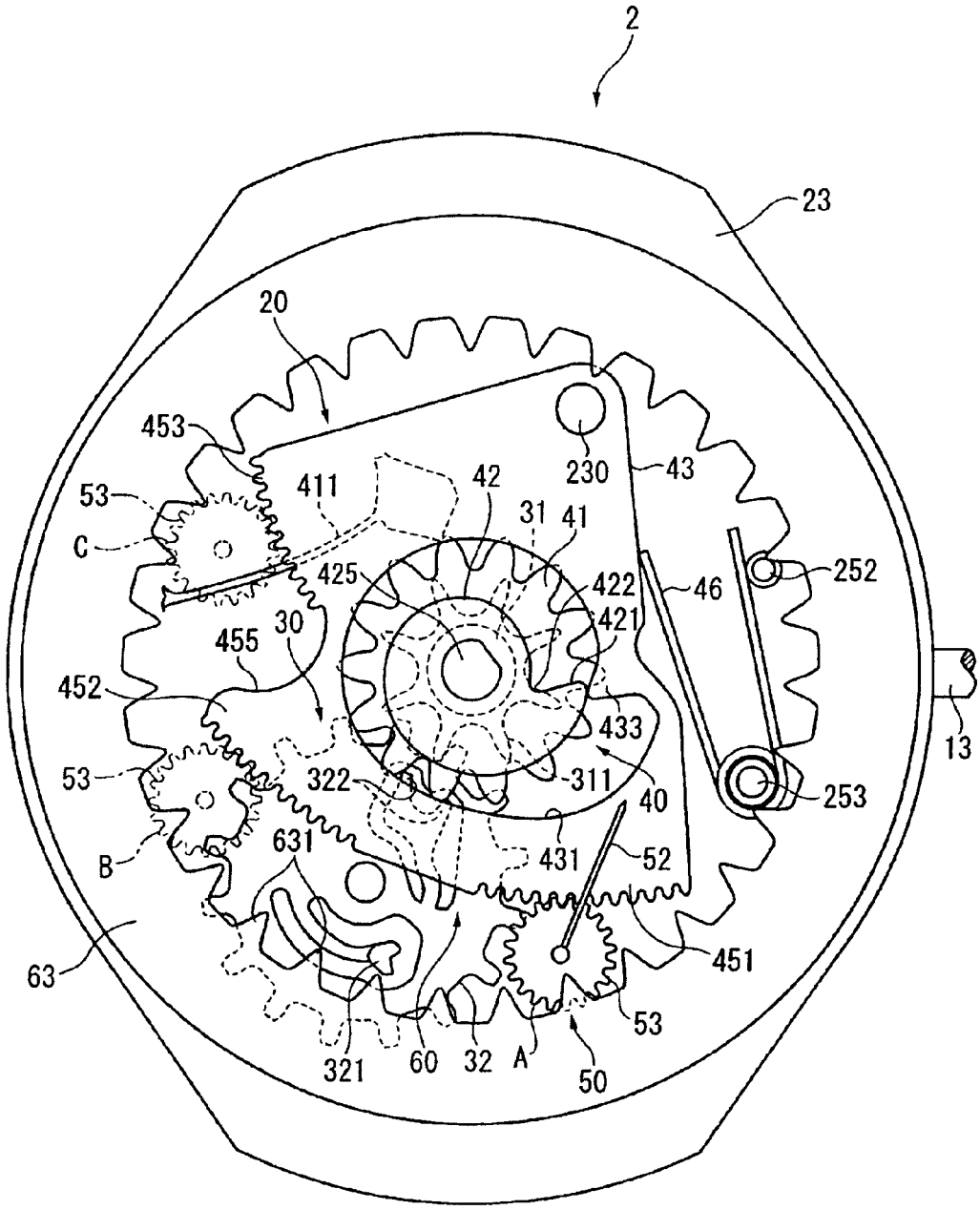
FIG. 2 is a plan view showing a movement of the timepiece in the first embodiment.
Figure 3:
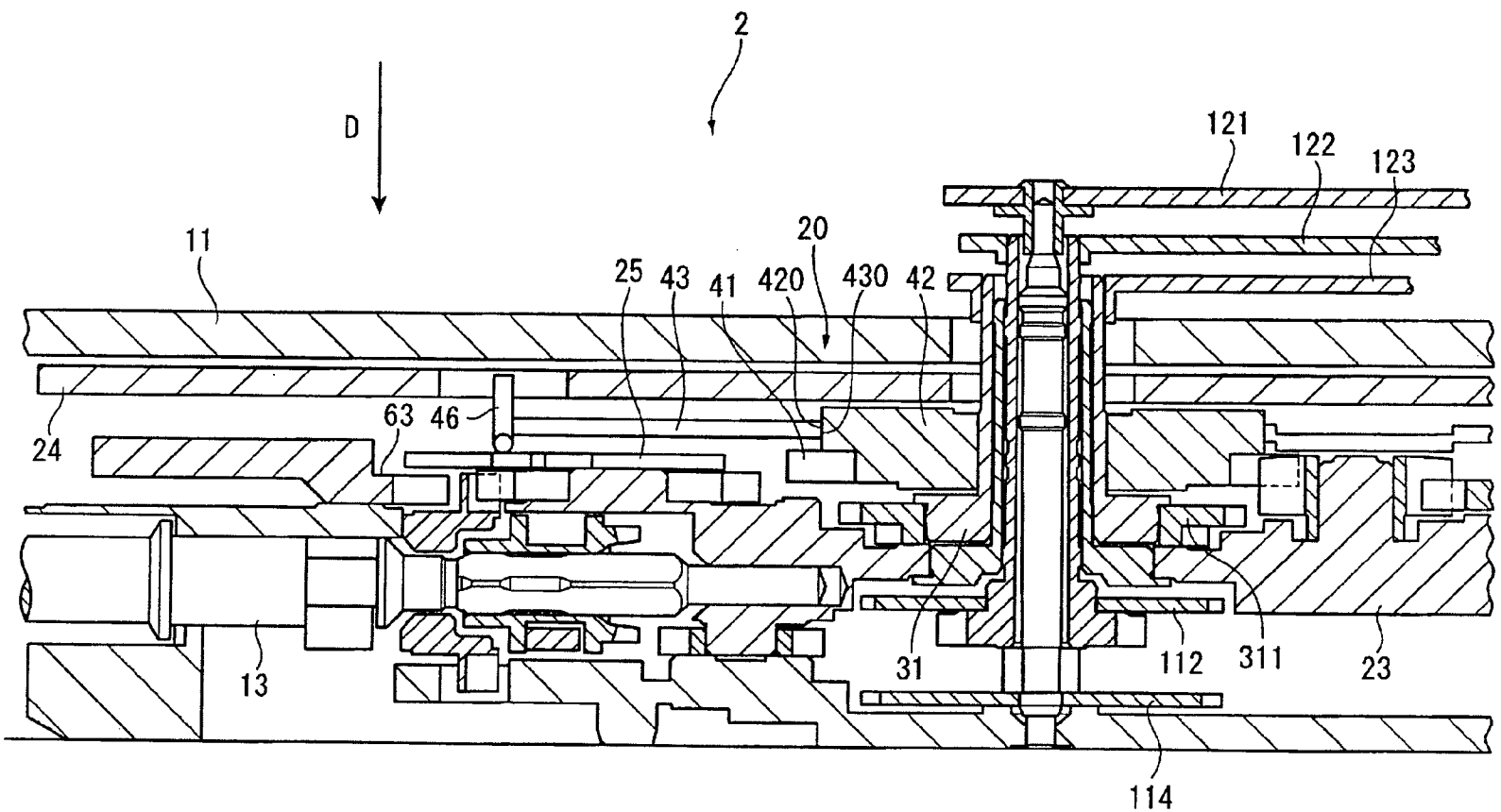
FIG. 3 is a partial cross-sectional view of a movement of the timepiece in the first embodiment.

FIG. 2 is a plan view of the movement 2 as seen from the dial 11 side, and FIG. 3 is a partial cross-sectional view of the movement 2.

The configuration for driving the seconds hand 121, the minute hand 122, and the hour hand 123 is similar to a regular analog quartz configuration. This configuration includes a circuit board with a crystal oscillator; a stepping motor having a coil, stator, and rotor; a drive train wheel having a seconds wheel and pinion 114, a center wheel and pinion 112, and an hour wheel 31 shown in FIG. 3 (also including a minute wheel, third wheel and pinion, and fifth wheel and pinion, not shown); and a battery as a power source. In this configuration, the stepping motor is driven by a pulse signal oscillated by the crystal oscillator and divided in frequency by means of a circuit block. The drive force of the stepping motor is then transmitted to the drive train wheel, whereby driving force is provided to the seconds hand 121 provided to the seconds wheel and pinion 114, the minute hand 122 provided to the center wheel and pinion 112, and the hour hand 123 provided to the hour wheel 31. The number of stepping motors is not specified, and, for example, one may be provided for driving the seconds hand 121, and one may be provided for driving the minute hand 122 and the hour hand 123, for a total of two stepping motors.

A date display device 60 relating to date display, and a day display device 20 relating to retro day display, to be described later, are incorporated into the movement 2.

The date display device 60 is configured including an hour wheel 31 disposed in the middle of a main plate 23 (see FIG. 3), a day indicator driving wheel 32 meshed with the hour wheel 31, and a ring-shaped date indicator 63 turned by the day indicator driving wheel 32, as shown in FIG. 2.

The hour wheel 31 is a sleeve-shaped gear that rotates once every twelve hours, and the hour hand 123 (FIG. 1) is mounted on the hour wheel 31. Also, the hour wheel 31 has a turning wheel 311 with eight teeth, and this turning wheel 311 meshes with the day indicator driving wheel 32, which has 16 teeth.

Therefore, the day indicator driving wheel 32 rotates at half the speed of the hour wheel 31, or once every day (24 hours). A date turning pawl 321 is formed on the day indicator driving wheel 32, and the date indicator 63 is turned one tooth a day by the date turning pawl 321.

The date indicator 63 has thirty-one teeth 631 in the internal periphery of the ring, and these teeth 631 are turned by the date turning pawl 321 to rotate once every thirty-one days. Though not shown in FIG. 2, the numbers "1" through "31" indicating the date are printed (or engraved) along the peripheral direction in the surface of the date indicator 63, and these numbers are displayed through the window 61 (FIG. 1).

The teeth 631 of the date indicator 63 are urged by the distal end of a jumper (not shown) whose proximal end side is mounted on the main plate 23. As a result of the urging force of this jumper, the date indicator 63 is driven intermittently, and the date display in the window 61 switches every day.

Next, the structure of the day display device 20, which is the most characteristic element of the present embodiment, will be described in detail.

The day display device 20 is disposed so as to be substantially housed in the internal periphery of the date indicator 63, and is configured including a gear train 30 for transmitting drive force, a control unit 40 that bears the drive force from the gear train 30 and moves the day hand 52 as a pointer member back and forth, and a pointer unit 50 in which the display unit 51 (FIG. 1) and the day hand 52 are contained.

Figure 4:
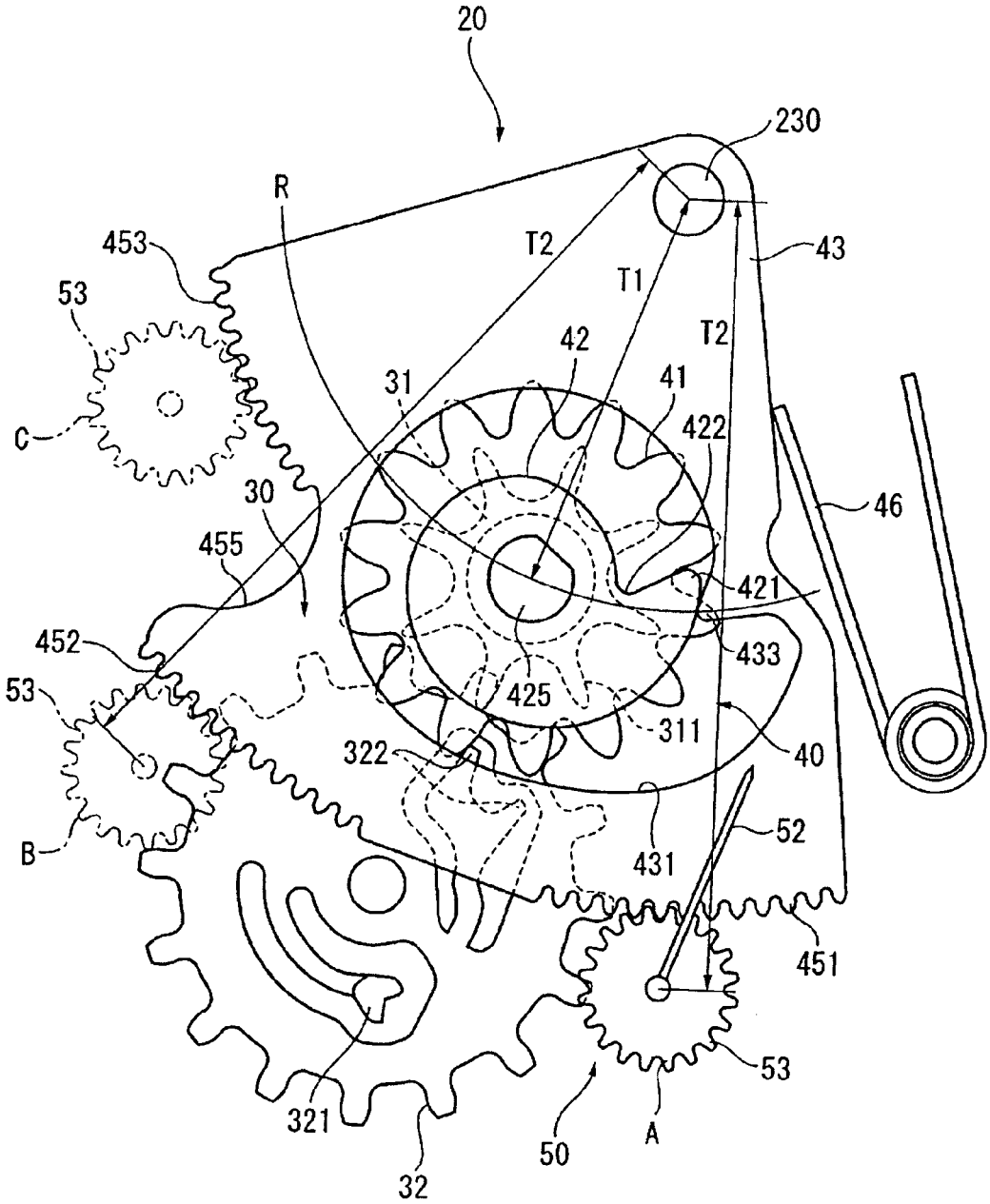
FIG. 4 is a plan view of a day display device in the first embodiment.
Figure 5:
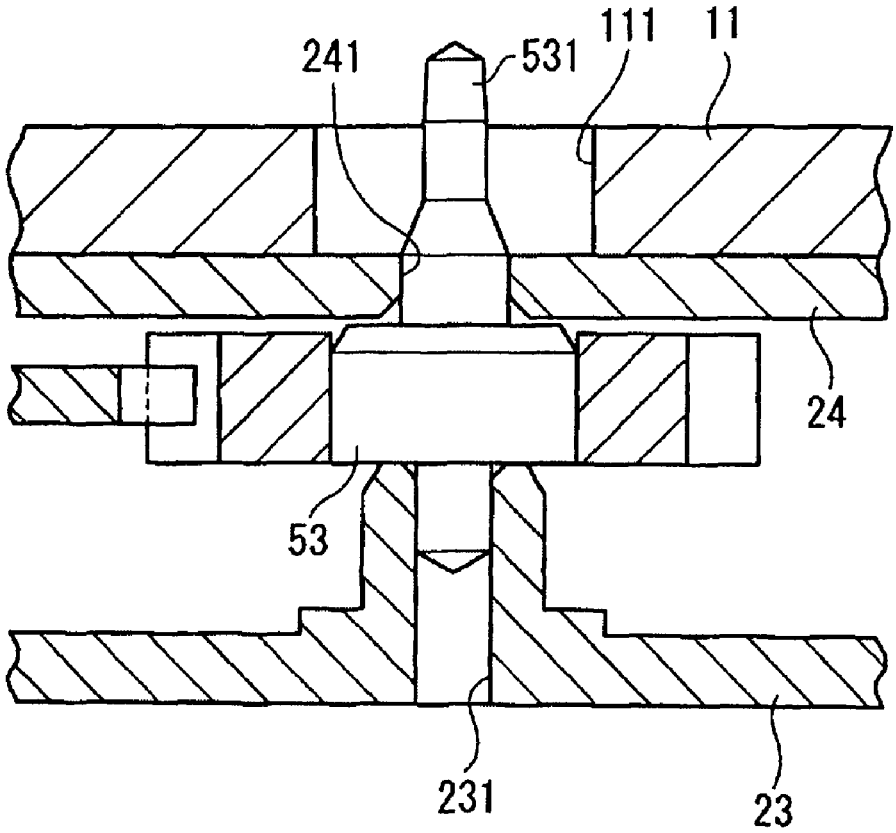
FIG. 5 is a cross-sectional view showing part of a day display device in the first embodiment.

FIG. 4 is an enlarged view of the day display device 20 in FIG. 2, and FIG. 5 is a cross-sectional view showing part of the day display device 20.

The gear train 30 includes the hour wheel 31 as a drive wheel, and the day indicator driving wheel 32 as an intermediate wheel.

The hour wheel 31 and the day indicator driving wheel 32 have a common configuration with the date display device 60 and the day display device 20. Two day turning pawls 322 are formed on the day indicator driving wheel 32, and a day intermediate wheel 41 is turned two teeth a day by the day turning pawls 322.

The control unit 40 is configured including the day intermediate wheel 41 as a driven wheel, a cam 42 formed integrally with the day intermediate wheel 41, and a rotatable lever 43 urged by a spring 46 in a state of contact with the cam 42. When viewed in planar fashion, the day intermediate wheel 41 and the cam 42 overlap, and the lever 43 rotates through the area overlapping with the day intermediate wheel 41.

The day intermediate wheel 41 has fourteen teeth, and is turned by the day turning pawls 322 of the day indicator driving wheel 32 to rotate once every seven days (every week). The day intermediate wheel 41 is provided so as to ensure coaxial rotation with the hour wheel 31.

Also, a jumper 411 is provided near the day intermediate wheel 41 in order to urge the teeth of the day intermediate wheel 41. The day intermediate wheel 41 is intermittently driven as a result of the urging force of the jumper 411.

The cam 42 is a flat cam that rotates once every seven days along with the day intermediate wheel 41, is formed in layered fashion with the day intermediate wheel 41, and is provided on the same axis as the hour wheel 31 between the main plate 23 and a holding plate 24 (FIG. 3) that faces the main plate. Specifically, the hour wheel 31, the day intermediate wheel 41, and the cam 42 are provided so as to rotate together on the same axis in the substantial middle of the main plate 23. The cam 42 is provided with one peak part 421, and the section from an open end 422 to the peak part 421 is formed into an Archimedean shape. The driven node of this cam 42 constitutes the lever 43.

The lever 43 is a circular thin plate member disposed so as to enclose the periphery of the cam 42, an opening (hole) 431 is formed to house the cam 42, and the lever is axially supported by a rotational axis 230 (FIG. 2) provided in the main plate 23 (FIG. 3) near the date indicator 63. The lever extends in a wide space in the date indicator 63 along the reverse side of the dial 11 (FIG. 1) at a position facing the main plate 23. A projection 433 that comes in contact with the cam 42 is formed on the inner side of the opening 431, and the lever 43 rotates around the rotational axis 230 due to the rotation of the cam 42. Specifically, the lever 43 is operated to rotate by the rotation of the cam 42 from the inner side of the area of rotation, and therefore an even simpler structure can be achieved than when the cam 42 is disposed in any other location.

Side surfaces 430 and 420 are disposed facing each other along the thickness direction D (FIG. 3) of the lever 43 and cam 42 in the timepieces 1A through 1C.

The outer peripheral shape of the lever 43 is a substantial fan shape centered around the rotational axis 230, as shown in FIG. 4; and a first gear part 451, a second gear part 452, and a third gear part 453 as three gear parts are aligned in the stated order on the arcuate portion of the lever 43 from one end to the other end of the arcuate portion.

Specifically, the rotational axis 230 of the lever 43 and the first through third gear parts 451 through 453 are disposed in mutually opposite directions at the rotational center of the hour wheel 31.

Also, if it is assumed that there exists an arc R that is centered around the rotational axis 230 of the lever 43 and that passes through the rotational axis 425 of the cam 42, the first through third gear parts 451 through 453 are disposed on the side (the outer side) of the arc R opposite the center side, and the rotational axis 425 of the cam 42 is disposed between the rotational axis 230 of the lever 43 and the first through third gear parts 451 through 453.

In the first gear part 451 and the second gear part 452, the distances (diameters) from the rotational axis 230 are the same, and in the third gear part 453, the dimension (diameter) from the rotational axis 230 is less than the same dimension in the first gear part 451 and the second gear part 452. Therefore, a step 455 is formed between the second gear part 452 and the third gear part 453.

The first through third gear parts 451 through 453 mesh with a small day indicator 53 and are capable of rotating the small day indicator 53 by a specific angle, whether the small day indicator 53 be disposed at the position A (the 5:00 position) shown by the solid line, the position B (the 8:00 position) shown by the single-dashed line, or the position C (the 10:00) position shown by the double-dashed line in FIG. 4. The teeth shape, number of teeth, and length of the tooth train in the first through third gear parts 451 through 453 are determined according to the tooth shape, number of teeth, and angle of rotation of the small day indicator 53. In the present embodiment, the shape of the teeth in the first through third gear parts 451 through 453 is the same, and the tooth trains are of substantially the same length.

Also, a spring 46 as an urging device, which is a linear member bent into a substantial U shape, is provided between the portion of the lever 43 on which the projection 433 is formed and the date indicator 63, as shown in FIG. 2. The spring 46 is locked in place around an axle portion 253 between the lever 43 and a protruding part 252 formed on a date indicator holder 25 (FIG. 3). The projection 433 comes in contact with the cam 42 due to the urging force of the spring 46. The spring 46 may be formed integrally with the lever 43. The date indicator holder 25 is omitted from FIG. 2 and FIG. 4.

The pointer unit 50 is configured having a small day indicator 53 as a pointer wheel, a day hand 52 (FIG. 1) mounted on the small day indicator 53, and a fan-shaped display unit 51 on the dial 11.

The display unit 51 is provided such that the center of the circle of the fan shape faces the internal periphery of the dial 11, and the arcuate portion of the fan shape faces the center of the dial 11, as shown in FIG. 1. The characters "SUN" through "SAT" are printed or engraved at specific intervals along the arc of fan shape of the display unit 51, constituting gradations 511 indicating the day.

The small day indicator 53 meshes with any of the first through third gear parts 451 through 453 depending on where it is positioned, and moves the day hand 52 (FIG. 1) mounted on a centrally located rotational axis 531.

In other words, the small day indicator 53 is capable of being incorporated not only at the position A (the 5:00) shown by the solid line in FIG. 4, but also at the position B (the 8:00 position) and the position C (the 10:00 position), and one of these positions A through C is selected as the position for incorporating the small day indicator 53. This is related to the model change of the timepiece 1A (FIG. 1), which will be described next.

This small day indicator 53 is axially supported between the main plate 23 and the holding plate 24 as shown in FIG. 5 at a position equivalent to the center O (FIG. 1) of the fan shape of the display unit 51. Axle holes 231 and 241 corresponding to the rotational axis 531 of the small day indicator 53 are formed respectively in the main plate 23 and the holding plate 24, and these axle holes 231 and 241 are formed at positions corresponding to the positions A through C (FIG. 4). A hole 111 through which the rotational axis 531 is inserted is formed in the dial 11.

Figure 6:
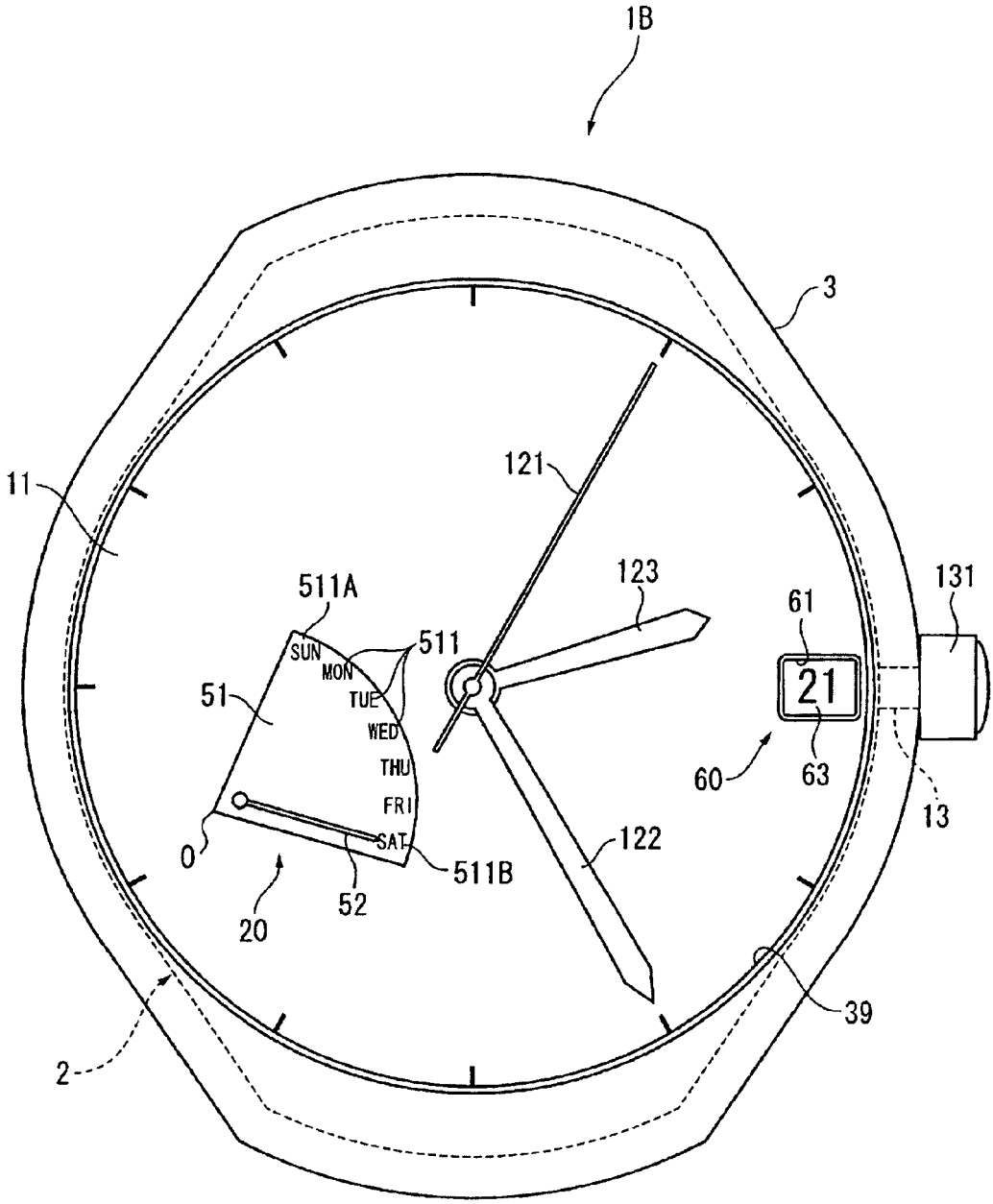
FIG. 6 is a plan view showing the external appearance of another model of a timepiece in the first embodiment.
Figure 7:
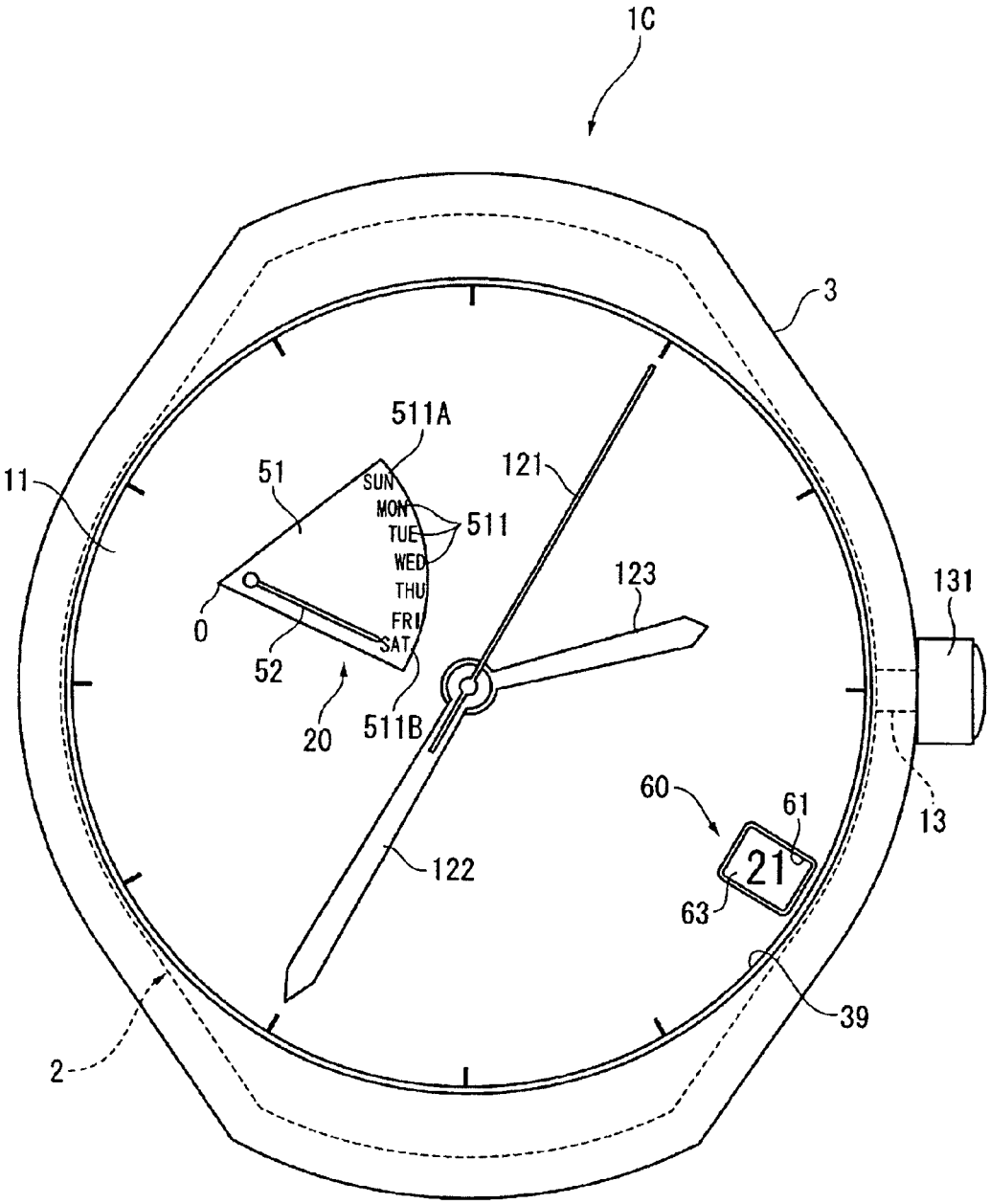
FIG. 7 is a plan view showing the external appearance of yet another model of a timepiece in the first embodiment.

A timepiece 1B and a timepiece 1C, which are different models than the timepiece 1A (FIG. 1), are shown in FIGS. 6 and 7. In the timepieces 1B and 1C, the positions of the display unit 51 and the window 61 in the dial 11 of the timepiece 1A have been changed. Specifically, in the timepiece 1A, the center of the circle of the fan shape of the display unit 51 is disposed in the 5:00 direction and the window 61 is disposed in the 12:00 direction, whereas in the timepiece 1B in FIG. 6, the center of the circle of the fan shape of the display unit 51 is disposed in the 8:00 direction and the window 61 in the 3:00 direction, and in the timepiece 1C in FIG. 7, the center of the circuit of the fan shape of the display unit 51 is disposed in the 10:00 direction and the window 61 in the 4:00 direction.

Although the positions of the display unit 51 and the window 61 are different in the timepiece 1A, 1B, and 1C, the movements 2 (FIG. 2) that include the day display devices 20 are the same. However, the position for incorporating the small day indicator 53 is changed according to the difference in the position of the display unit 51. Specifically, in the timepiece 1A, the small day indicator 53 is incorporated at the position A shown by the solid line in FIG. 2, and the small day indicator 53 is incorporated at the position B shown by the single-dashed line in the timepiece 1B, and at the position C in the timepiece 1C.

The timepieces 1A through 1C differ in the orientation of the display unit 51, or, in other words, in the range in which the day hand 52 rotates. Specifically, the display unit 51 in the timepiece 1A (FIG. 1) and the timepiece 1B (FIG. 6) widens from the fan shape center O of the display unit 51 to the substantial center of the dial 11 where the minute hand 121 through hour hand 123 are mounted, whereas the display unit 51 in the timepiece 1C (FIG. 7) widens from the fan shape center O of the display unit 51 in the direction centered on the substantial 2:00 position of the dial 11 without passing through the middle. The orientation of the display unit 51, or the range of rotation of the day hand 52, changes depending on the orientation of the day hand 52 mounted when the small day indicator 53 is incorporated at positions A through C (FIG. 2). Consequently, when the small day indicator 53 and the cam 42 are incorporated, the position of the small day indicator 53 is adjusted in accordance with the phase position of the cam 42 so that the direction of indication of the day hand 52 coincides with the orientation of the display unit 51 in the timepieces 1A through 1C.

In the present embodiment, the angle of rotation of the small day indicator 53 is about 80° when the small day indicator 53 is incorporated at positions A and B (FIG. 2), and about 60° when it is incorporated at position C. Specifically, when the small day indicator 53 is incorporated at position C, since the third gear part 453 has a smaller diameter than the first gear part 451 and the second gear part 452, the small day indicator 53 is turned by a smaller amount by the rotation thereof, and the angle of rotation of the day hand 52 mounted on the small day indicator 53 is also smaller. The angle of the fan shape of the display unit 51 (FIGS. 1, 6, and 7) is also set to an angle corresponding to the angle of rotation of the day hand 52.

Also, in the present embodiment, the position of the window 61 in relation to the date display device 60 is changed as previously described according to the position of the display unit 51 on the dial 11 in each model of the timepieces 1A, 1B, and 1C. This is because the position of the display unit 51 and the position of the window 61 are located at a distance from each other in the design, but the configuration is not limited thereto and the display unit 51 and window 61 may also be located adjacent to each other.

The numbers 1 through 31 printed on the date indicator 63 have different orientations in the timepieces 1A through 1C, so that the characters on the date indicator 63 seen through the window 61 are displayed with the 12:00 direction at the top and the 6:00 direction at the bottom.

The configurations of the timepieces 1A, 1B, and 1C were described above. Next, the operation of the day display device 20 will be described. The day display device 20 operates in the same manner regardless of which position A through C in FIG. 2 the small day indicator 53 has been incorporated into.

The drive force of the stepping motor is transmitted to the hour wheel 31 via a gear train (not shown), and the hour wheel 31 rotates once every 12 hours, or twice every day. The rotation of the hour wheel 31 is reduced by half when transmitted from the hour wheel 31 to the day indicator driving wheel 32, and the day indicator driving wheel 32 rotates once every day. The day intermediate wheel 41 is then turned by two teeth every day by the day turning pawls 322 of the day indicator driving wheel 32. The drive force transmitted to the day intermediate wheel 41 is reduced to 1/7 and is transmitted using the rotational speed of the day indicator driving wheel 32 as a reference.

The rotation of the day intermediate wheel 41 is transmitted to the cam 42 via the day intermediate wheel 41, and the entire cam 42 and day intermediate wheel 41 rotate once every seven days (every week).

The cam 42 and the lever 43 constitute the control unit 40, the lever 43 rotates due to the rotation of the cam 42, and the day hand 52 moves through the display unit 51 by means of the small day indicator 53 that is meshed with any of the first through third gear parts 451 through 453. Specifically, as a result of the rotation of the cam 42, the projection 433 in contact with the cam 42 is distanced from the rotational center of the cam 42, and the entire lever 43 rotates counterclockwise in FIG. 2 around the rotational axis 230. As a result of the rotation of the lever 43, the small day indicator 53 meshed with any of the first through third gear parts 451 through 453 rotates forward (clockwise in FIG. 2), and the U shaped portion of the spring 46 elastically deforms, accumulating flexure (spring force). The day hand 52 then moves according to the rotation of the small day indicator 53, and the gradations 511 of the display unit 51 are indicated in sequence by the day hand 52.

Since the dimension T2 between the rotational axis 230 of the lever 43 and the rotational axis 531 of the small day indicator 53 is about twice the dimension T1 between the rotational axis 230 of the lever 43 and the rotational axis 425 of the cam 42, the lever 43 is reliably rotated by the rotation of the cam 42, and the amount of displacement of the lever 43 in the tooth train of the first and second gear parts 451 and 452 is increased to near twice the amount of displacement in the projection 433 in contact with the cam 42, and therefore the small day indicator 53 can be reliably and easily turned at a specific angle of rotation.

Thus, when the day hand 52 has progressed to the last position 511B (FIG. 1) of the gradations 511 of the display unit 51, the lever 43 moves to a state of contact near the peak part 421 of the cam 42, and when the day intermediate wheel 41 has next been turned by the day turning pawls 322 in this state, the cam 42 rotates along with the rotation of the day intermediate wheel 41 and the cycle of the cam 42 is ended. When cycle of the cam 42 is ended, the portion where the projection 433 and the cam 42 are in contact moves intermittently from the peak part 421 to the open end 422, the lever 43 rotates clockwise in FIG. 2, and the spring 46 recoils. At this time, the small day indicator 53 rotates in the opposite direction due to the rotation of the lever 43, and the day hand 52 is returned (reset) to the initial position 511A of the gradations 511 of the display unit 51. The next cycle of the cam 42 then begins, and the two-way movement of the day hand 52 is performed in seven day cycles by repeatedly rotating the small day indicator 53 forwards and backwards in sequence according to the rotation of the lever 43 according to the rotation of the cam 42, as previously described.

The first embodiment described above has the following effects.

(1) Since the day display device 20 in the timepieces 1A through 1C is configured such that the first through third gear parts 451 through 453 are formed on the lever 43 and the small day indicator 53 can be incorporated at any of the positions A through C, the timepieces 1A through 1C of different models can be easily manufactured merely by varying the position where the small day indicator 53 is incorporated. In the timepieces 1A through 1C, since the rotational center or rotational range of the day hand 52 on the dial 11 differs, as do the position and orientation of the display unit 51, variation in the outward design can be easily achieved.

Axis holes 231 and 241 are formed in advance in the positions A through C for incorporating the small day indicator 53, and the movement 2 is common among the timepieces 1A through 1C, which has merits in that there is no need to change the configuration of the movement 2 that contains the day display device 20 with each change in the model. Costs can thereby be greatly reduced.

(2) Since the day display device 20 is configured from the hour wheel 31, the day indicator driving wheel 32, the day intermediate wheel 41, the small day indicator 53, and other such gears, as well as the cam 42, the lever 43, and other such simple components, the structure of the retro day display device 20 can be prevented from becoming complicated. Therefore, the day display device 20 can be easily designed and assembled, and the quality can be stabilized. Also, since the structure is not complicated, it is also easy to provide a women's model of a smaller size.

Furthermore, it is easy to place the day display device 20 on the internal peripheral side of the ring-shaped date indicator 63, and the entire structure of the movement 2 thereby does not become complicated. The degree of freedom with the design can thereby be greatly improved.

(3) Since the hour wheel 31, the day intermediate wheel 41, and the cam 42 are provided in the substantial middle of the main plate 23 so as to ensure coaxial rotation, a larger space for the lever 43 can be set aside from the substantial center of the main plate 23 to the inner edge, the lever 43 can have various shapes. Therefore, it is possible to provide three positions A through C for incorporating the small day indicator 53. Three models can thereby be achieved with one movement 2. Also, the cost for one model can be reduced, and product development with a greater variety can be promoted.

The positions for incorporating the small day indicator 53 are not limited to the three positions A through C, and it is also possible to provide two or four or more positions for incorporating the small day indicator 53.

(4) Also, since the drive force of the hour wheel 31 is reliably transmitted to the day intermediate wheel 41 and cam 42 that are rotated on the same axis, the rotation of the lever 43 is reliably controlled by the rotation of the day intermediate wheel 41 and cam 42, and the operation of the day display device 20 can be stabilized.

(5) Since the lever 43 is in the shape of a thin plate, the lever 43 can be formed at a position facing the main plate 23 to freely extend along the reverse side of the dial 11 to the positions A through C for incorporating the small day indicator 53. The degree of freedom in the design can thereby be remarkably improved.

Also, the lever 43 can be installed so as to be covered by the day indicator driving wheel 32 or other gear trains disposed on the main plate 23, which allows the lever to be easily incorporated. Specifically, the day display device 20 can be easily incorporated in the movement 2 without changing the configuration of the components already incorporated in the movement 2.

(6) In the date display device 60 used together with such a day display device 20, the alignment of the characters on the date indicator 63, the configuration of the design, the position and shape of the window 61 in the dial 11, and other such features can be easily changed without changing the movement 2 merely by replacing the date indicator 63 or the dial 11. It is thereby simple to change the position of the window 61 and to change the orientation of the characters on the date indicator 63 in accordance with the direction of indication of the day hand 52 and the positions of the display unit 51 constituting the day display device 20.

Therefore, timepiece models with much variation can be provided at low cost by combining the display design in the date display device 60 and the design in the day display device 20.

(7) Because of the facing arrangement of the side surfaces 430 and 420 of the lever 43 and cam 42, which run along the thickness direction D (FIG. 3) of the timepieces 1A through 1C, bulkiness is prevented in the thickness direction D of the timepieces 1A through 1C in the middle portion of the main plate 23 on which the lever 43 and cam 42 are disposed. Particularly, since the cam 42 is housed in the opening 431 of the lever 43, and the lever 43 is disposed so as to encircle the outer periphery of the cam 42, it is possible for the planar position at which the lever 43 rotates and the planar position at which the cam 42 rotates to lie substantially in the same plane. Therefore, the day display device 20 does not become bulky in the thickness direction D of the timepieces 1A through 1C, and the timepieces 1A through 1C can be made thinner. Also, since the cam 42 is formed into a circular shape, the strength of the lever 43 can be improved.

(8) Since a step 455 is provided to the arcuate portion of the lever 43, and the diameters of the first gear part 451 and second gear part 452 are different from the diameter of the third gear part 453, the amount by which the small day indicator 53 is turned in relation to the angle of rotation of the lever 43 changes according to the position where the small day indicator 53 is incorporated. The angle of rotation of the day hand 52 provided to the small day indicator 53 thereby changes, and different models can therefore be manufactured.

Also, different timepiece designs can be obtained since the distance from the rotational axis 230 to the small day indicator 53 changes according to the position where the small day indicator 53 is incorporated, and the center of rotation of the day hand 52 in the dial 11 changes according thereto. Specifically, it is possible to change the angle of rotation of the small day indicator 53 in addition to changing the position of the rotational center of the day hand 52, merely by providing a step 455 to the circular portion of the lever 43, which is part of the configuration of the day display device 20, which makes many design variations possible.

(9) Also, the rotational axis 230 of the lever 43 and the rotational axis 531 of the small day indicator 53 are housed on the internal peripheral side of the ring-shaped date indicator 63, and the day display device 20 is disposed so as to be mostly housed in the internal periphery of the date indicator 63, which is favorable in terms of space.

(10) The rotational axis 230 of the lever 43 and the first through third gear parts 451 through 453 are disposed in substantially opposite directions from each other in relation to the rotational center of the hour wheel 31, or, in other words, the rotational axis 230 of the lever 43 and the first through third gear parts 451 through 453 are disposed sandwiching the hour wheel 31 on either side. This provides a favorable arrangement in terms of space and allows for a greater distance from the rotational axis 230 of the lever 43 to the first through third gear parts 451 through 453 than when the rotational axis 230 of the lever 43 and the first through third gear parts 451 through 453 are disposed adjacent to each other. The amount of rotation of the lever 43 rotated by the rotation of the cam 42 can thereby be increased, and there is no need to increase the amount of displacement (gap) of the cam 42 when a large amount of rotation is envisioned for the lever 43. If the gap of the cam 42 is increased, the cam 42 transmits drive force to the lever 43, the lever 43 is returned, and the urging force acting on the lever 43 must therefore be increased to an extent that overcomes the frictional resistance of the lever 43 and cam 42 and the like. It is therefore possible to achieve the same amount of rotation in the lever 43 with a smaller amount of displacement in the cam 42 and a smaller torque, and the motive force needed to operate the day display device 20 can be reduced.

Also, the return operation of the lever 43 by means of the rotation of the cam 42 can be achieved by the urging force acting between the lever 43 and the cam 42, and chatter of the day hand 52 can be prevented because the first through third gear parts 451 through 453 that rotate via the lever 43 reliably mesh with the small day indicator 53.

(11) Since the dimension T2 from the rotational axis 230 of the lever 43 to the rotational axis 531 of the small day indicator 53 disposed on the first and second gear parts 451 and 452 is substantially twice the dimension T1 from the rotational axis 230 of the lever 43 to the rotational axis 425, the lever 43 can be reliably rotated by the rotation of the cam 42, and the small day indicator 53 can be reliably and easily turned with a specific angle of rotation.

The ratio of the dimension T2 to the dimension T1 is set to substantially 2 to make it possible for a timepiece of common size to be housed in the movement 2 and the components to be easily machined, but this dimension ratio may be appropriately set within a range of 1.5 to 2.5. If the ratio of T2 to T1 is less than 1.5, the small day indicator 53 may not be turned sufficiently, and if the ratio exceeds 2.5, it is difficult to incorporate the day display device 20 into the movement 20.

(12) Furthermore, since the dimension T2 is substantially twice the dimension T1 (this ratio can be arbitrarily set within a range of 1.5 to 2.5), sufficient length can be ensured in the arcuate portion of the fan-shaped lever 43, and three positions A through C for incorporating the small day indicator 53 can be provided along the first through third gear parts 451 through 453 formed on this arcuate portion. The timepieces 1A through 1C of different models can thereby be easily manufactured merely by changing the position for incorporating the small day indicator 53. Since the rotational center of the day hand 52 or the position of the display unit 51 on the dial 11 differs in the timepieces 1A through 1C, variation in the outward design can be easily achieved. The costs for each model can thereby be reduced, and product development can be promoted.

The movement 2 including the day display device 20 is common in the timepieces 1A through 1C, which has merits in that there is no need to change the configuration of the day display device 20 when changing the model. Costs can thereby be greatly reduced.

Figure 8:
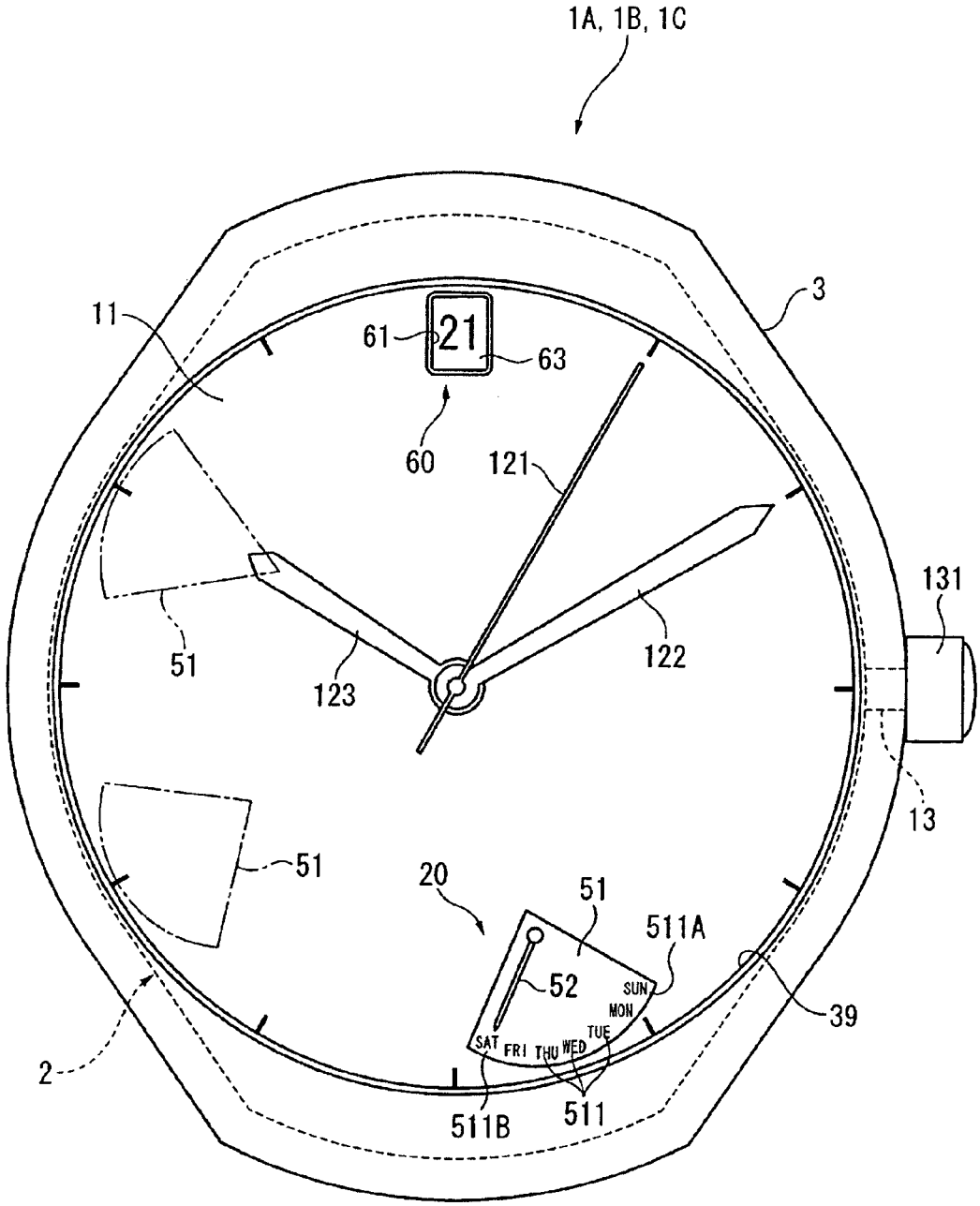
FIG. 8 is a plan view showing a modification of the first embodiment.

As a modification of the present embodiment, the display unit 51 may also be provided with an orientation that extends from the inner side of the dial 11 to the outer peripheral side, with the day hand 52 pointing in a direction from the inner side of the dial 11 to the outer peripheral side, as shown in FIG. 8. The display units 51 shown by the solid line, the single-dashed line, and the double-dashed line in FIG. 8 correspond to cases in which the small day indicator 53 is incorporated at the position A (solid line), position B (single-dashed line), and position C (double-dashed line) in FIG. 2.

With this configuration, a common movement 2 in the first embodiment can be used in the timepieces 1A through 1C shown in FIGS. 1, 6, and 7. Specifically, the direction in which the day hand 52 points and the orientation of the display unit 51 provided on the dial 11 can be freely varied by adjusting the position for incorporating the cam 42 and the position for incorporating the small day indicator 53 among the positions A through C shown in FIG. 2. Thus, since the direction in which the day hand 52 points and the orientation of the fan shape of the display unit 51 in the timepieces 1A through 1C can be changed, many different timepiece models can be created with one movement 2.

Second Embodiment

Next, the second embodiment of the present invention will be described.

The present embodiment is different from the first embodiment in the use of a different diameter for the small day indicator 53 incorporated at position A (FIG. 2) in the movement 2.

Figure 9:
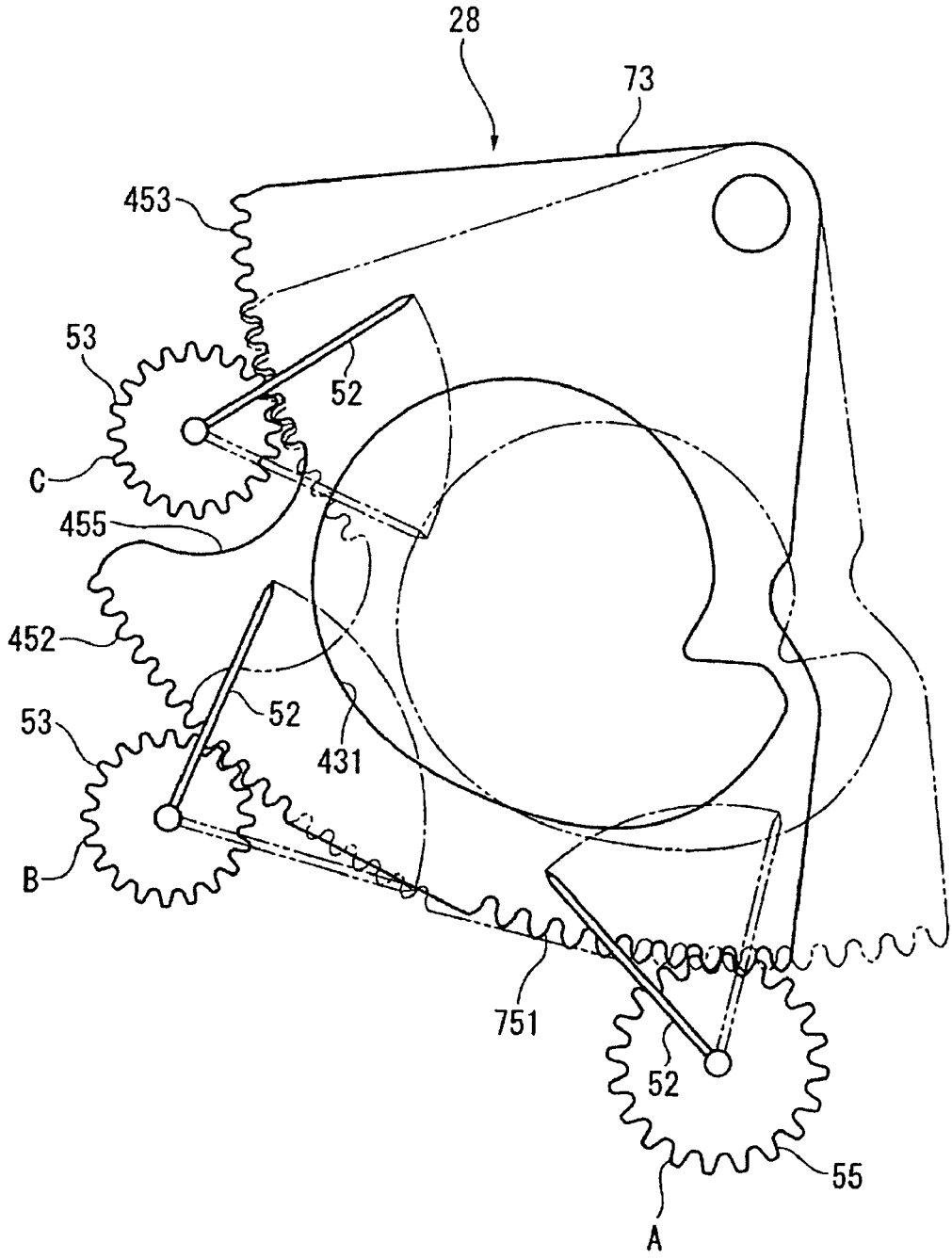
FIG. 9 is a schematic plan view showing the display device of the timepiece in the second embodiment of the present invention.

FIG. 9 is a schematic plan view depicting a lever 73 and small day indicators 53 and 55 constituting a day display device 28 of the present embodiment. In FIG. 9, a small day indicator 53 or a small day indicator 55 is shown at each of the positions A through C for the sake of simplifying the description, but in actuality, only one small day indicator 53 or 55 is incorporated at one of the positions A through C.

In the present embodiment, the diameter of the small day indicator 55 disposed at the position A is greater than the diameter of the small day indicator 53 disposed at the position B. Also, the pitch of the teeth of the small day indicator 55 is greater than the pitch of the teeth of the small day indicator 53. Accordingly, the pitch of the teeth of the first gear part 751 is also greater than the pitch of the teeth of the second gear part 452 in the lever 73. Specifically, the shapes of the teeth are different in the first gear part 751 and the second gear part 452.

The operation will now be described for the small day indicators 55 and 53 that mesh with the first gear part 751 and second gear part 452 that have the same diameter when the lever 43 is rotated from the state shown by the solid line in FIG. 9 to the state shown by the double-dashed line. The small day indicator 53 disposed at position B is rotated by meshing with the second gear part 452, and the day hand 52 mounted on the small day indicator 53 rotates. The angle of rotation of the day hand 52 at this time is about 80°, and the angle of the fan shape of the display unit 51 is set to an angle that corresponds to this 80°.

The small day indicator 55 disposed at position A in FIG. 9 is larger in diameter than the small day indicator 53 meshed with the second gear part 452, whereby it is turned by the first gear part 751 by a lesser amount than the small day indicator 53, and the angle of rotation of the day hand 52 mounted on the small day indicator 55 is about 60°. The angle of the fan shape of the display unit 51 corresponds to the 60° angle of rotation of the day hand 52.

Figure 10:
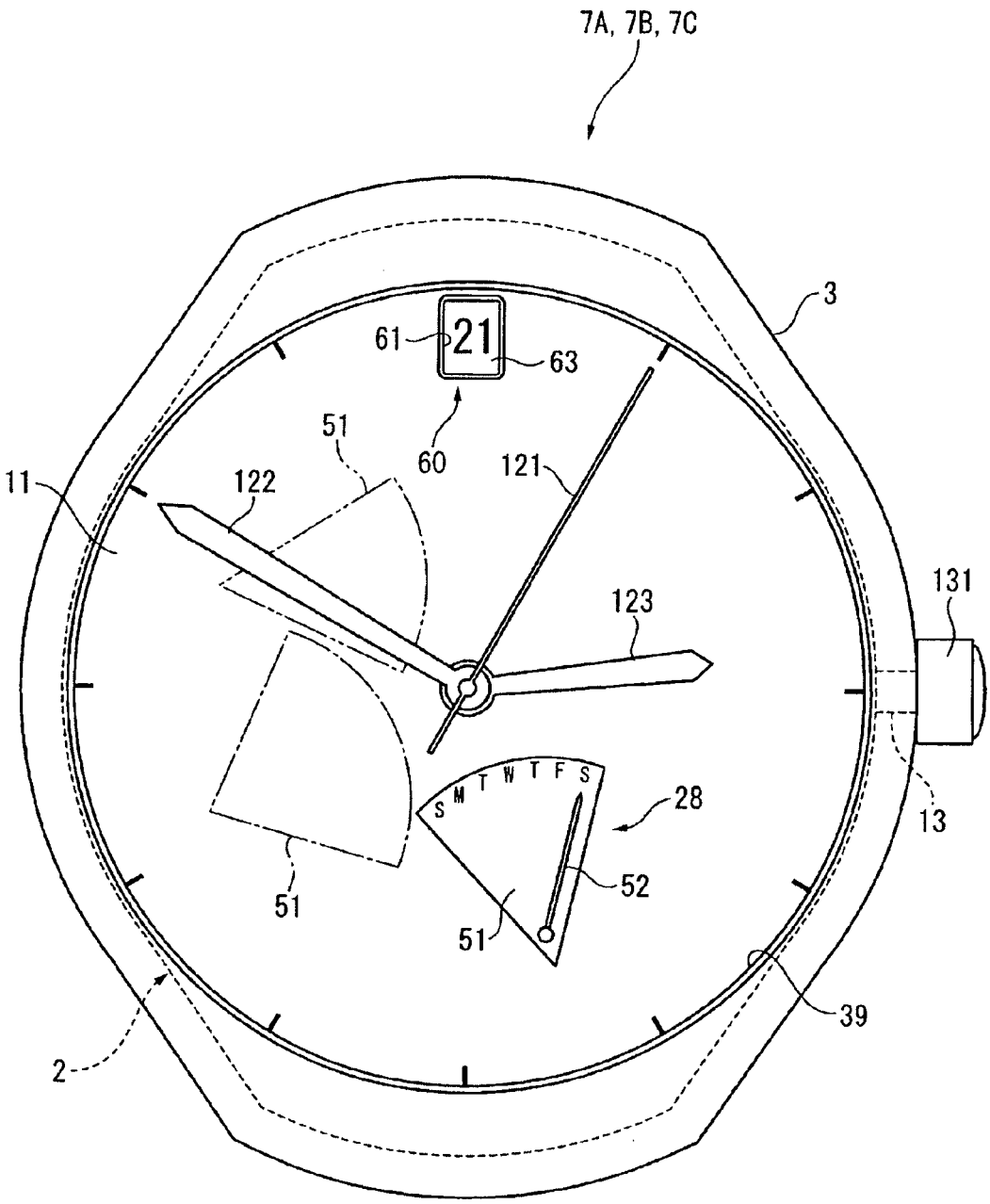
FIG. 10 is a plan view showing the outer appearance of a timepiece in the second embodiment.

An external view of a timepiece 7A (7B, 7C) in which this day display device 28 is incorporated is shown in FIG. 10. The display units 51 shown by the solid line, the single-dashed line, and the double-dashed line in FIG. 10 correspond to cases in which the small day indicators 55 and 53 are incorporated at the position A (solid line), position B (single-dashed line), and position C (double-dashed line), respectively, shown in FIG. 9. Thus, three timepiece models, specifically, the timepieces 7A through 7C, can be manufactured according to the position for incorporating the small day indicator 53 or 55, and a common movement 2 containing the day display device 28 is used for each model.

In the second embodiment, the same operational effects as the first embodiment can be obtained.

Also, in addition to the rotational center of the day hand 52 and the position of the display unit 51 differing with each of the models of the timepieces 7A through 7C, the models also differ in the angle of rotation of the day hand 52 and the angle of the fan shape of the display unit 51, and the outward design of the dial 11 can be further varied. Changing the model has merits in that only the diameter of the small day indicators 53 and 55 need be changed, and there is no need to change any other configurations in the day display device 28.

Third Embodiment

Next, the third embodiment of the present invention will be described.

The levers 43 and 73 in the first and second embodiments both have an opening 431 and are formed into circular shapes, but the shape of the lever in the present embodiment is different.

Figure 11:
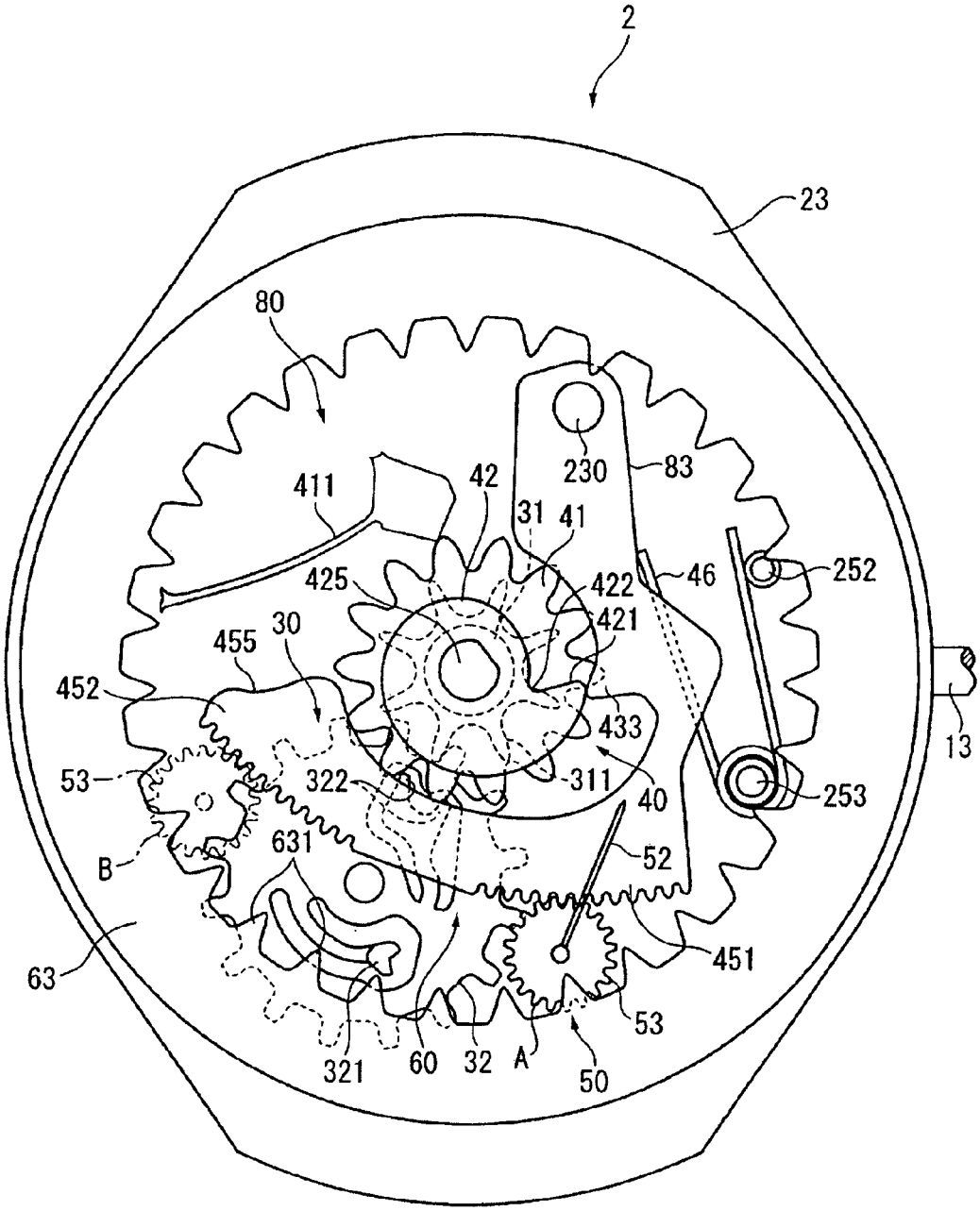
FIG. 11 is a plan view showing the movement of a timepiece in the third embodiment of the present invention.

FIG. 11 shows a day display device 80 incorporated into the movement 2 of the present embodiment.

The lever 83 in the day display device 80 is formed into a substantial L shape so as to enclose the periphery of the cam 42, wherein one end is supported on the rotational axis 230, and two partial gear parts, that is, the first gear part 451 and the second gear part 452 meshed with the small day indicator 53, are formed on the other side. Also, a projection 433 that comes in contact with the cam 42 is formed on the inner side of the L shape of the lever 83.

In this day display device 80, there are two positions where the small day indicator 53 can be disposed: position A where it meshes with the first gear part 451, and position B where it meshes with the second gear part 452; and the small day indicator 53 is incorporated at either one of these positions A and B.

There is no gear train formed between the first and second gear parts 451 and 452, but the present invention is not limited thereto, and the first and second gear parts 451 and 452 may be connected to each other to form a gear train.

The configuration of the day display device 80 of the present embodiment is substantially similar to the day display device 20 (FIG. 2) of the first embodiment, except for the number of positions where the small day indicator 53 can be incorporated. According to the present embodiment, substantially similar operational effects as those previously described in the first embodiment can be achieved.

Fourth Embodiment

Next, in the fourth embodiment of the present invention, a case will be described in which another display device is incorporated into the movement 2 instead of the retro day display device 20 of the first embodiment.

Figure 12:
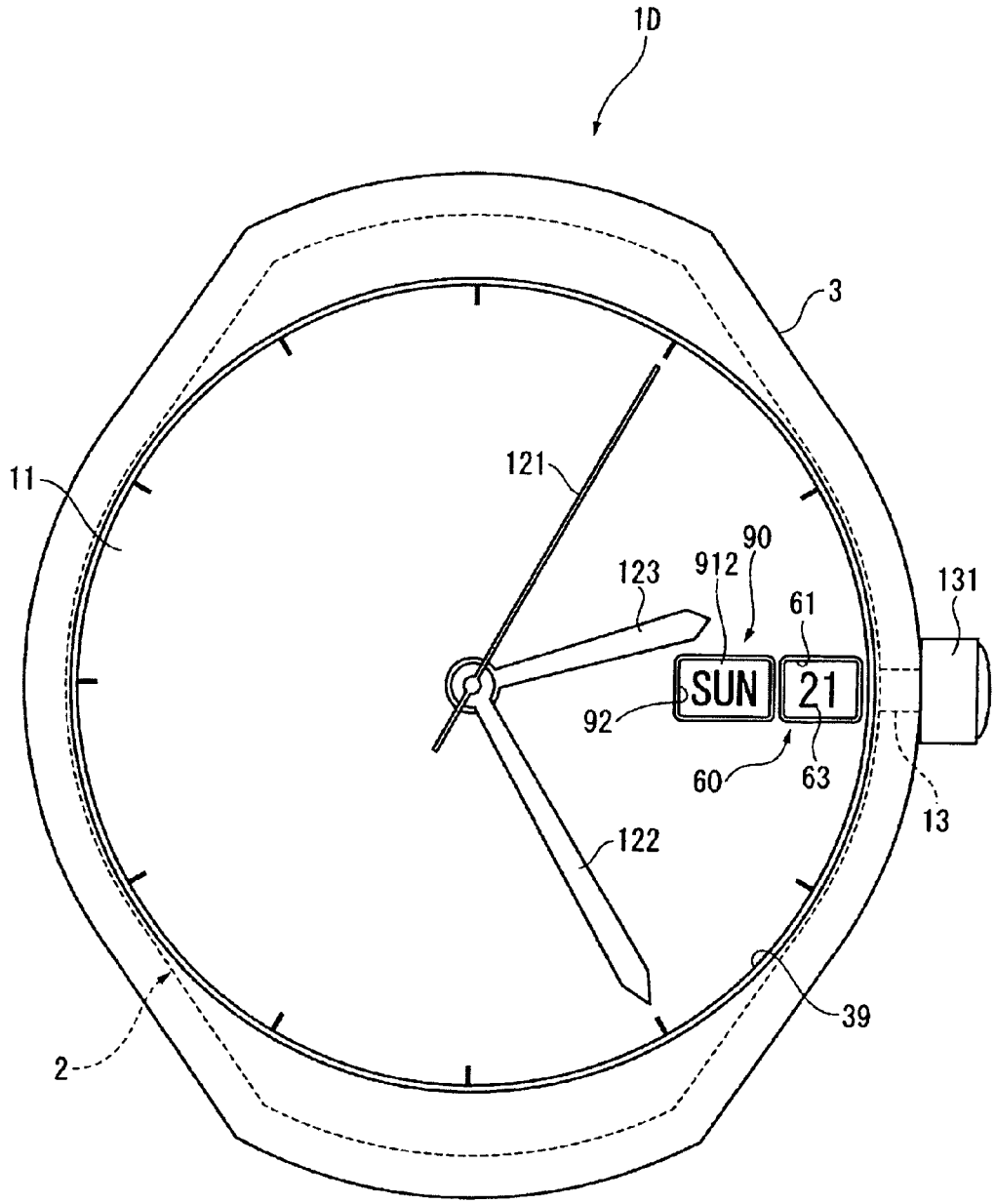
FIG. 12 is a plan view showing the outer appearance of a timepiece in the fourth embodiment of the present invention.
Figure 13:
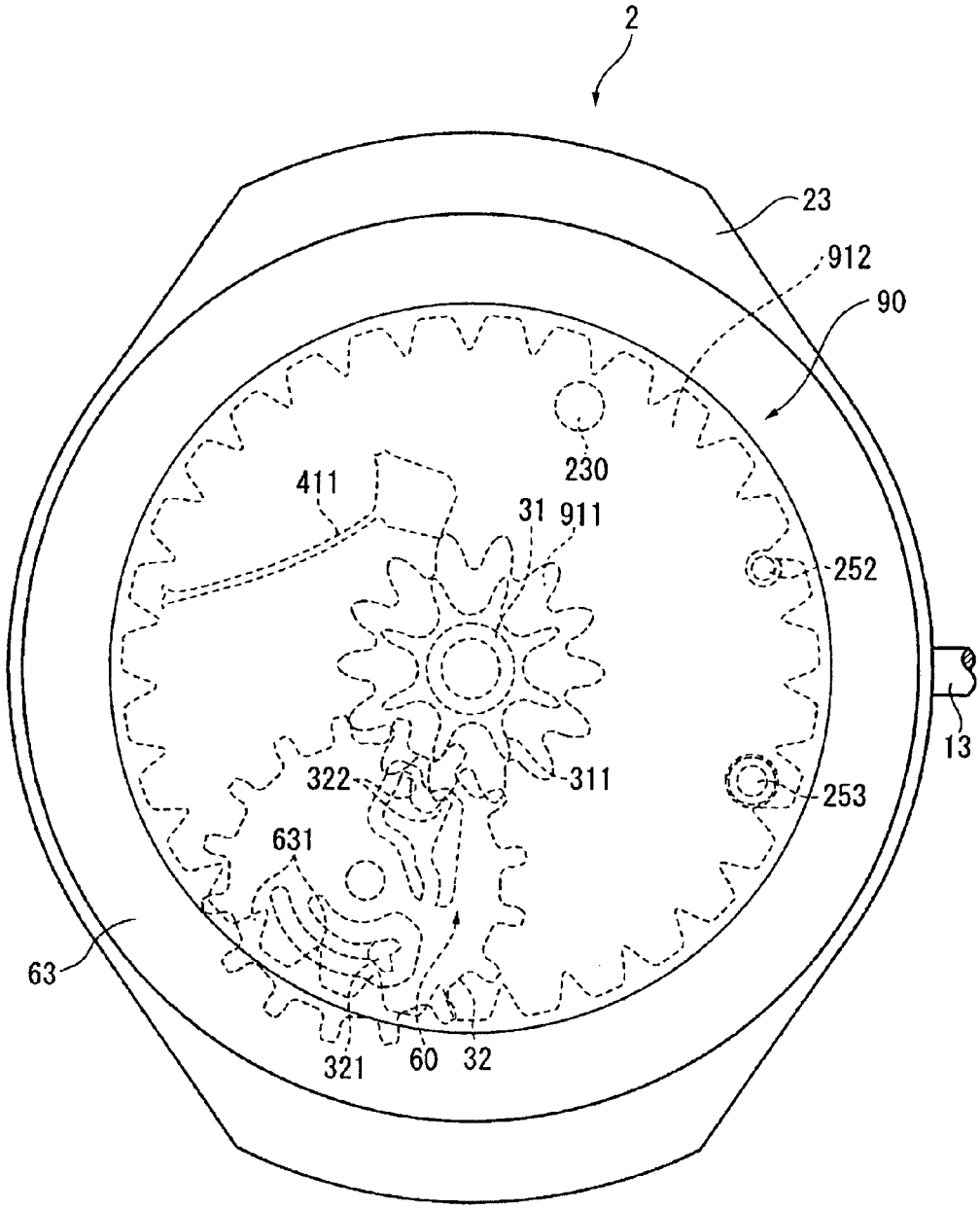
FIG. 13 is a plan view showing the movement of a timepiece in the fourth embodiment.
Figure 14:
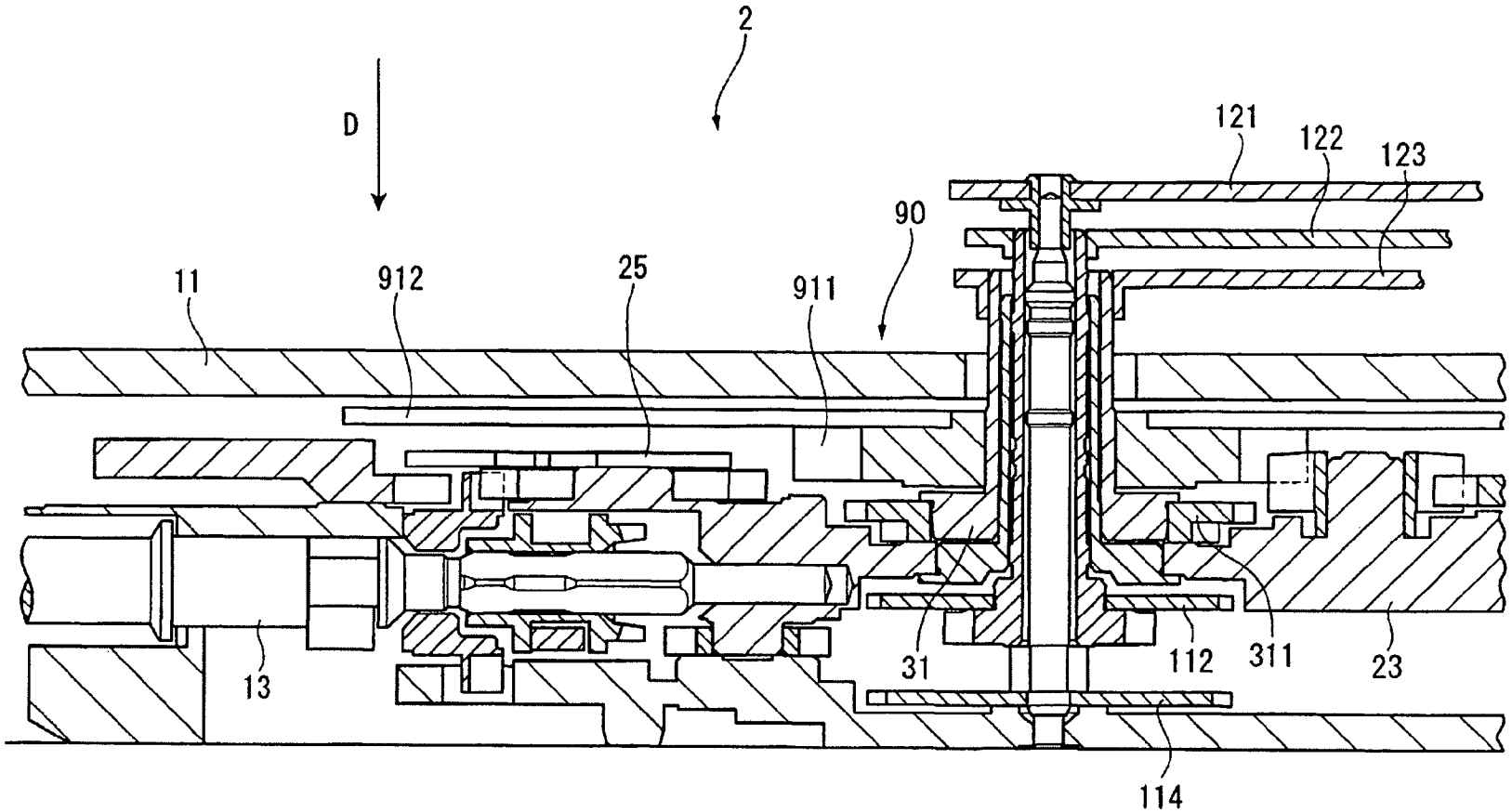
FIG. 14 is a partial cross-sectional view of the movement of a timepiece in the fourth embodiment.

FIG. 12 shows the outer appearance of a timepiece 1D in the present embodiment, and FIG. 13 shows the movement 2 of the timepiece 1D. Also, FIG. 14 is a partial cross-sectional view of the movement 2.

A day display device 90 that displays the day by the rotation of a circular plate is incorporated into the movement 2 instead of the day display device 20 (FIG. 2).

The rotational axis 230 of the lever 43 in the day display device 20, the axle portion 253 on which the spring 46 is interlocked, and the protruding part 252 remain as they are on the main plate 23 or the date indicator holder 25 (FIG. 3) even if the day display device 20 is removed.

The day display device 90 has an hour wheel 31 and a day indicator 91 as a driven wheel that are provided to the substantial middle of the main plate 23. The device also has a day indicator driving wheel 32 and a day window 92 formed adjacent to the window 61 for displaying the date in the dial 11.

The day indicator 91 is configured having a day star wheel 911, which is provided on the same axis as the hour wheel 31, and a day display plate 912, which is a circular plate mounted on the day star wheel 911. A jumper 411 is in contact with the day star wheel 911, and the day star wheel 911 is driven intermittently by the urging force of the jumper 411.

The day star wheel 911 is disposed at the position where the day intermediate wheel 41 and the cam 42 are disposed in the day display device 20.

In FIG. 13, only the lever 43, the spring 46, the small day indicator 53, the day hand 52, and the holding plate 24 of the day display device 20 are removed from the movement 2.

Though not shown in FIG. 13, the characters "SUN" through "SAT" indicating the day are printed (or engraved) on the day display plate 912 along the peripheral direction. The rotational axis 230, the axle portion 253, and the protruding part 252 are disposed between the day display plate 912 and the main plate 23 or the day indicator holder.

In this day display device 90, the day indicator driving wheel 32 is rotated by the rotation of the hour wheel 31, and the day star wheel 911 is turned by the day turning pawls 322 of the day indicator driving wheel 32, whereby the day indicator 91 rotates once every seven days (every week). The characters on the day display plate 912 are displayed sequentially through the day window 92, as shown in FIG. 12, due to the rotation of the day indicator 91.

Specifically, the day display device 90 can be incorporated into the movement 2 instead of the day display device 20 shown in FIG. 2, whereby a timepiece 1D with a different day display system can be provided in addition to the timepieces 1A through 1C previously described.

As shown in the second and third embodiments, since either the day display device 28 or 90 can be incorporated into the movement 2, any of the day display devices 20, 28, 80, and 90 can be selected and incorporated into the movement 2.

The rotational axis 230, the axle portion 253, the protruding part 252, and other such components formed on the main plate 23 of the movement 2 are used in any of the day display devices 20, 28, and 80, and the rotational axis 230, axle portion 253, protruding part 252, and the like do not cause any hindrance when incorporated into the day display device 90. In other words, the day display devices 20, 28, 80, and 90 incorporated into the movement 2 are mutually exchangeable, and a common display device or movement can be used in each timepiece model.

As shown in the present embodiment, although the movement 2 is common, appropriately selecting the day display device 20, 28, 80, or 90 to be incorporated into the movement 2 makes possible a retro display due to the day display device 20, 28, 80, or 90, as well as a display through the day window 92 in the dial 11 in the day display device 90. Since the movement 2 is common, various display aspects can be easily achieved at low cost, which is extremely beneficial for developing timepiece models.

In the present embodiment, a day display device 90 was shown in which the day was displayed through the day window 92 by rotating the day display plate 912, but various other aspects have also been considered for the display device incorporated in the movement 2, such as an aspect in which the gradations provided on the dial are sequentially indicated by the rotation of the pointers, for example.

Modifications

The present invention is not limited to the embodiments previously described. Specifically, the present invention is particularly illustrated and described primarily in relation to the specified embodiments, but those skilled in the art can make various modifications to the shapes, materials, quantities, and other specific factors of the embodiments described above without deviating from the scope of the technological ideals and objects of the present invention.

In the embodiments previously described, examples were given of the position of the rotational center of the day hand 52, the angle of rotation, the direction in which the hand pointed, the center O of the fan shape of the display unit 51, and the angle of the fan shape, but the positions of the rotational centers of the pointer members, the angles of rotation, the direction in which the pointers point, the center position of the fan shape of the display unit, and the angle of the fan display unit can be configured arbitrarily.

Specifically, as described in the previous embodiments, the rotational center and the angle of rotation of the pointer members are determined by the diameter of the pointer wheel and the gear parts, and by the relationship of the shape of the teeth to the number of teeth; and the direction in which the pointers point is determined by the positional alignment of the pointer wheel, the lever, the cam, and the like when the pointer wheel is incorporated.

In the first embodiment, a step 455 is formed in the arcuate portion of the lever 43, and the arcuate portion is divided into three portions, which are the first through third gear parts 451 through 453. These first through third gear parts 451 through 453 correspond to the positions A through C for incorporating the small day indicator 53, respectively, but the present invention is not limited thereto, and another possibility under consideration is to evenly form a gear train without forming a step in the arcuate portion of the lever so that a plurality of gear parts are connected, and to provide a plurality of positions for incorporating the pointer wheel along these gears.

The shape of the pointer members is not limited to a hand as in the previous embodiments, and another possibility is to use a character design or a design having an illustration of an animal or a flower, for example.

It is acceptable for the shape of the display unit to only show the arcuate portion of the fan shape.

In the previous embodiments, a retro day display based on the day display device 20 was used, but the display device of the present invention is not limited to showing the day, and can also be used in a calendar display showing the date, month, year, and the like; a date reminder display for important dates; and also a time display showing the hours, minutes, and seconds. In such cases, the deceleration rate (acceleration rate) of the drive wheel, driven wheel, gear parts, and pointer wheel is appropriately set so as to result in a turned amount corresponding to the object of the display. The number of teeth in the hour wheel 31, the day indicator driving wheel 32, and the day intermediate wheel 41 shown in the previous embodiments is merely an example.

Also, in the previous embodiments, the levers 43 and 73 were configured as one member, but the lever is not limited thereto, and may be configured with the gear part portion of the lever as a separate member. For example, the main body of the lever can be formed into a substantial V shape, the gear parts can be formed into a fan shape overlapping the V shape of the lever, and the lever and gear parts can be assembled on the same axis.

The position where the pointer wheel is disposed can be arbitrarily selected from a plurality of positions according to the space on the main plate and the like, and even if the movement is designed so that the pointer wheel can be disposed only at one of the plurality of positions in this space, the display device can be assembled by appropriately selecting the position for incorporating the pointer wheel. Specifically, additions to a model having a retro display function based on the display device of the present invention can be easily made.

The opening 431 formed in the lever 43 in the previous embodiments was a through-hole, but instead of a through-hole, this opening may also be a concavity (blind hole).

Also, the lever in the present invention may be a circular shape or a substantial L shape as in the previous embodiments, or an S shape or C shape, and may also have a contact part for the cam on the inner side portion of the curve, as long as the shape encloses the periphery of the cam

FIELD OF INDUSTRIAL APPLICABILITY

According to the present invention, the structure can be simplified, and it is possible to provide a display device for a timepiece wherein the model is easily changed, and to provide a timepiece having this display device.

Particularly, it is possible to provide many models by providing many positions for disposing (incorporating) the pointer wheels, proportionate to the amount by which the space for accommodating the lever is increased by providing the drive wheel, the driven wheel, and the cam so as to ensure coaxial rotation. In each of these models, a common movement is used, and costs can therefore be reduced.

The invention claimed is:

1. A display device for a timepiece, comprising:

a drive wheel configured for rotation around a first axis, the drive wheel being an hour wheel on which an hour hand is mounted;

a driven wheel configured for rotation around the first axis in respect to rotation of the drive wheel;

a cam configured for rotation around the first axis in respect to the rotation of the driven wheel;

a rotatable lever configured to contact the cam for rotation around a second axis, the rotation lever having a gear portion;

a first pointer wheel operably coupled with the gear portion, for rotation around a third axis clockwise and counter-clockwise by the rotatable lever, the first pointer wheel having a pointer member displaying information; and an intermediate wheel having a turning pawl for turning the driven wheel, the intermediate wheel configured such that the power is transferred from the hour wheel to the driven wheel through the intermediate wheel, the intermediate wheel configured on a fourth axis being different from the first axis.

2. The display device for a timepiece according to claim 1, wherein a side surface of the rotatable lever and the cam along a direction of the first axis face each other.

3. The display device for a timepiece according to claim 2, wherein the second axis and the gear portion are disposed in substantially opposite directions in relation to the first axis.

4. The display device for a timepiece according to claim 3, wherein a first distance between the second axis and the third axis is 1.5 to 2.5 times larger than a second distance between the second axis and the first axis.

5. The display device for a timepiece according to claim 4, wherein the gear portion has a first gear part, second gear part, and third gear part, and the first pointer wheel meshes with one of the first, second, and third gear part.

6. The display device for a timepiece according to claim 5, further comprising a urging device urging the rotatable lever to a state of contact with the cam.

7. The display device for a timepiece according to claim 6, further comprising an intermediate wheel operably connecting the drive wheel and the driven wheel, the intermediate wheel having a turning pawl turning the driven wheel.

8. The display device for a timepiece according to claim 7, wherein each distance from each of the first gear part, second gear part, and third gear part to the second axis is mutually different and/or each of the first gear part, second gear part, and the third gear part has different tooth shapes.

9. The display device for a timepiece according to claim 1, wherein the second axis and the gear portion are disposed at opposite sides of the first axis.

10. The display device for a timepiece according to claim 1, wherein a first distance between the second axis and the third axis is 1.5 to 2.5 times larger than a second distance between the second axis and the first axis.

11. The display device for a timepiece according to claim 1, wherein the gear portion has a first gear part, second gear part, and third gear part, and the first pointer wheel meshes with one of the first, second, and third gear part.

12. The display device for a timepiece according to claim 11, wherein each distance from each of the first gear part, second gear part, and third gear part to the second axis is mutually different and/or each of the first gear part, second gear part, and the third gear part has different tooth shapes.

13. The display device for a timepiece according to claim 11, further comprising a second pointer wheel configured to be coupled with the gear portion, for rotation by the rotatable lever, and a third pointer wheel configured to be coupled with the gear portion, for rotation by the rotatable lever, wherein each of the first, second, and third pointer wheels has mutually different diameters and/or tooth shapes.

14. The display device for a timepiece according to claim 1, further comprising a urging device urging the rotatable lever to a state of contact with the cam.

15. The display device for a timepiece according to claim 1, further comprising an intermediate wheel operably connecting the drive wheel and the driven wheel, the intermediate wheel having a turning pawl turning the driven wheel.

16. The display device for a timepiece according to claim 1, wherein the lever at least partially encloses a periphery of the cam, and the rotatable lever has a projection contacting the cam.

17. A timepiece, comprising the display device according to claim 1, and a fan-shaped display unit configured such that the first pointer wheel overlays the fan-shaped display.

18. The timepiece according to claim 17, further comprising a ring-shaped gear having a display showing date or time provided along a periphery of the ring-shaped gear, wherein the second axis and the third axis are disposed on an internal peripheral side of the ring-shaped gear.

19. A display device for a timepiece, comprising:

a drive wheel configured for rotation around a first axis;

a driven wheel configured for rotation around the first axis in respect to rotation of the drive wheel;

a cam configured for rotation around the first axis in respect to the rotation of the driven wheel;

a rotatable lever configured to contact the cam for rotation around a second axis, the rotation lever having a gear portion; and a first pointer wheel operably coupled with the gear portion, for rotation around a third axis clockwise and counter-clockwise by the rotatable lever, the first pointer wheel having a pointer member displaying information, the rotatable lever having a hole, the first axis and the cam being configured in the hole.

20. The display device for a timepiece according to claim 1, wherein the intermediate wheel is configured in power train between the hour wheel and the driven wheel.

* * * * *